US007561831B2

(12) United States Patent
Naoi et al.

(10) Patent No.: US 7,561,831 B2
(45) Date of Patent: Jul. 14, 2009

(54) IMAGE FORMING APPARATUS, METHOD OF CONTROLLING SAME, PROGRAM FOR CONTROLLING, AND RECORDING MEDIUM FOR PROGRAM

(75) Inventors: Hiroo Naoi, Nara (JP); Mitsuru Tokuyama, Kyoto (JP); Hiroshi Kubota, Kadoma (JP); Kouichi Takenouchi, Tenri (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 543 days.

(21) Appl. No.: 11/352,382

(22) Filed: Feb. 13, 2006

(65) Prior Publication Data

US 2006/0182456 A1 Aug. 17, 2006

(30) Foreign Application Priority Data

Feb. 14, 2005 (JP) ..... 2005-036953

(51) Int. Cl.
*G03G 15/08* (2006.01)

(52) U.S. Cl. ..... 399/257

(58) Field of Classification Search ..... 399/257, 399/50, 55, 56

See application file for complete search history.

(56) References Cited

U.S. PATENT DOCUMENTS 5,260,740 A 11/1993 Seto
7,260,345 B2 * 8/2007 Kamiya ..... 399/257
2006/0228125 A1 * 10/2006 Itagaki et al. ..... 399/55

FOREIGN PATENT DOCUMENTS

| | | | | |
|---|---|---|---|---|
| JP | 5-150627 | A | | 6/1993 |
| JP | 6-83183 | A | | 3/1994 |
| JP | 6-89061 | A | | 3/1994 |
| JP | 2000-155460 | A | | 6/2000 |
| JP | 2000-275949 | A | | 10/2000 |
| JP | 2002116585 | A | * | 4/2002 |
| JP | 2003330271 | A | * | 11/2003 |
| JP | 2004-061958 | A | | 2/2004 |
| JP | 2005091395 | A | * | 4/2005 |

* cited by examiner

*Primary Examiner*—David M Gray
*Assistant Examiner*—Erika Villaluna
(74) *Attorney, Agent, or Firm*—Birch, Stewart, Kolasch & Birch, LLP

(57) ABSTRACT

An image forming apparatus of the present invention includes main control section for controlling the charging control section and the development bias control section so that a potential difference between the photoconductor potential and the development bias potential in developer discharge from the development section is smaller than that in the image forming. Therefore, even when an amount of developer in the development section decreases due to developer discharge, increase of beads-carry-over onto the photoconductor from the development section can be prevented. Accordingly, damage to the photoconductor or image errors due to incomplete cleaning that are caused by beads-carry-over can be prevented.

13 Claims, 20 Drawing Sheets

FIG. 1 (a) IN IMAGE FORMING MODE
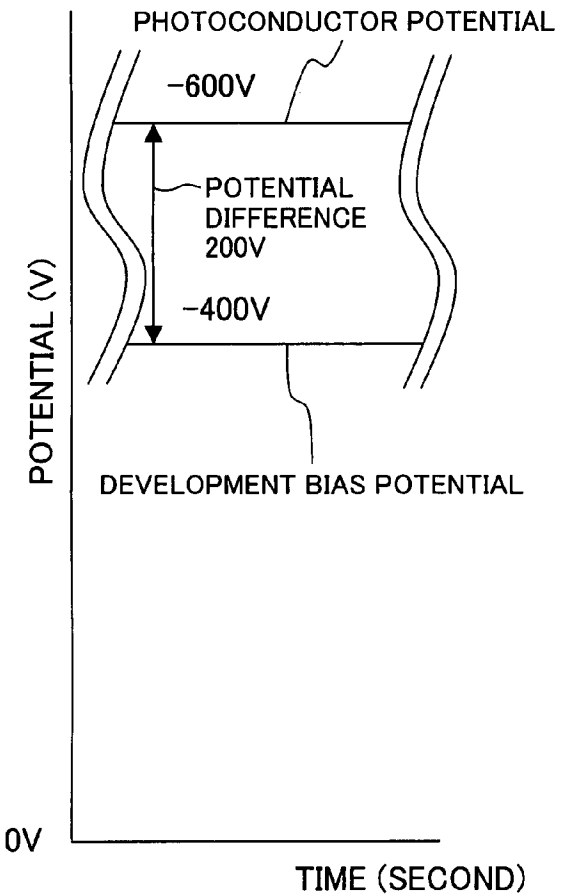
FIG. 1 (b) IN DEVELOPER DRAIN MODE
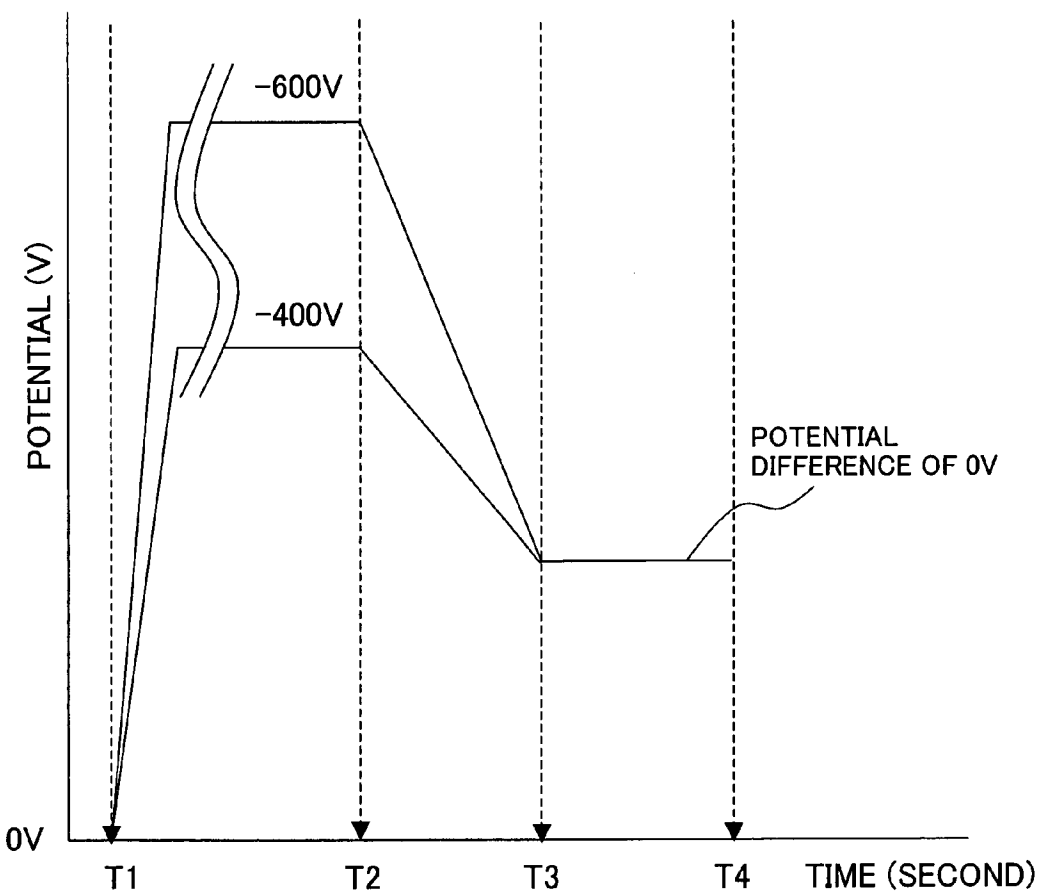

IMAGE FORMING APPARATUS, METHOD OF CONTROLLING SAME, PROGRAM FOR CONTROLLING, AND RECORDING MEDIUM FOR PROGRAM

This Nonprovisional application claims priority under 35U.S.C. § 119(a) on Patent Application No. 36953/2005filed in Japan on Feb. 14, 2005, the entire contents of which are hereby incorporated by reference.

FIELD OF THE INVENTION

The present invention relates to an image forming apparatus that visualizes, using powdery developer, an electrostatic latent image formed on a photoconductor by electrophotographic printing, electrographic printing, or other printing methods. More specifically, the present invention relates to an image forming apparatus including a function of discharging waste developer, a method of controlling the image forming apparatus, a program for controlling, and a recording medium storing the program.

BACKGROUND OF THE INVENTION

In an image forming apparatus including a development unit adopting a two-component development using toner and carrier, when duration of developer (two component developer) expires, errors in image density, such as fog, are generated. Therefore, when the duration of the developer expires, the developer needs to be discharged and replaced.

However, it is complicated and time-consuming to discharge and replace the developer. Therefore, these works are usually done by a maintenance specialist. This, however, causes a disadvantage to a user. Specifically, this causes a loss of time between the expiration of the duration and actual replacement of the developer.

In view of the above disadvantage, an image forming apparatus including automatic-developer-discharge means has been suggested. For example, Japanese Unexamined Patent Publication No. 89061/1994 (Tokukaihei 6-89061, published on Mar. 29, 1994) discloses a development unit including automatic-developer-discharge means. The automatic-developer-discharge means has two transport screws, and one of them, that is disposed closer to the bottom of the developer tank, has a diameter larger than the other, thereby improving efficiency of discharging developer.

Further, Japanese Unexamined Patent Publication No. 61958/2004 (published on Feb. 26, 2004) suggests an automatic developer discharge technique in which developer is automatically discharged from the development unit and new developer is automatically supplied.

Further, Japanese Unexamined Patent Publication No. 155460/2000 (published on Jun. 6, 2000) suggests another automatic developer discharge technique in which an output voltage of the toner density sensor is detected, thereby assuredly discharging the developer and constantly maintaining a predetermined amount of developer after new developer is supplied.

However, none of the above publications teaches controlling the process of developer discharging. Therefore, the techniques of the above publications have a problem that a carrier is shifted from a development sleeve to a photoconductor (so-called beads-carry-over).

In an image forming apparatus adopting the two-component development, developer is made of two kinds of components: carrier and toner, and therefore, depending upon a potential difference between the photoconductor and the development sleeve, it may cause shifting of toner onto the photoconductor (development, fog), shifting of carrier onto the photoconductor or even out of a developer tank (this is so-called beads-carry-over and will be referred to as beads-carry-over hereinafter). The carrier shifted onto the photoconductor is rubbed and collected by a cleaning blade.

If the amount of the beads-carry-over photoconductor increases, a surface of the photoconductor and an edge of the cleaning blade are damaged when the carriers are collected and removed by the cleaning blade. This causes some kind of error in image forming because of incomplete cleaning or the like. Recently, OPC (Organic Photoconductor) photoconductors have been popularly used as the photoconductor, which more easily causes the above problem.

FIG. 19 is a graph showing a relationship between (i) an amount of residual developer in a developer tank at the time when the developer (waste developer) is discharged from the developer tank, and (ii) an amount of the beads-carry-over (a number of carriers shifted (moved) to the photoconductor per area unit on a surface of the photoconductor). FIG. 20 is a graph showing a relationship, based on FIG. 19, between (i) a developer discharge time (elapsed time from when the developer discharge is started) and (ii) the amount of the beads-carry-over to the photoconductor.

As shown in FIG. 19, the amount of developer in the developer tank decreases with a decrease in the amount of developer shifted to the development sleeve (MG), and this also causes a decrease in congestion of magnetic chains, resulting in an increase of the amount of the beads-carry-over. When the developer in the developer tank decreases to a certain amount at which the magnetic chains on the development sleeve is brought out of contact with the photoconductor, the beads-carry-over stops.

Further, as shown in FIG. 20, as the developer discharging time increases, the amount of the beads-carry-over to the photoconductor becomes greater. When the developer just starts discharging, a sufficient amount of magnetic chains exist on the development sleeve (the congestion of the magnetic chains is high). Therefore, the amount of the beads-carry-over gradually increases. As more and more amount of developer is discharged, the congestion of the magnetic chains on the development sleeve becomes sparser and sparser. This results in a decrease in magnetic flux density. Consequently, magnetic suction force exerted on the carriers becomes weak. As a result, the amount of the beads-carry-over rapidly increases. When the amount of developer in the developer tank further decreases to a certain point at which the magnetic chain on the development sleeve completely disappears (when the developer in the developer tank decreases to a certain amount at which the magnetic chains on the development sleeve is brought out of contact with the photoconductor), the beads-carry-over stops.

As described above, as the amount of developer in the developer tank decreases, the congestion of the magnetic chains of developer on the development sleeve becomes sparse, and the amount of the beads-carry-over tends to increase.

Specifically, due to magnetic force of the development sleeve, carriers and toners form chains, and are kept on the development sleeve. When the chains are brought into contact with the photoconductor, a carrier is physically and electrostatically disconnected from the chains. At this time, if the congestion of the magnetic chains is high, the separated carrier can be magnetically collected by a neighboring magnetic chain. On the other hand, if the congestion of the magnetic chains is low, there would be a fewer number of neighboring magnetic chains for magnetically collecting the separated carrier, and therefore the carrier released from the magnetic retention moves to the photoconductor, resulting in the beads-carry-over.

As described above, the amount of developer in the developer tank decreases as the developer is discharged, and the amount of the beads-carry-over gradually increases. This causes scratches on a surface of the photoconductor, resulting in some kind of error in image forming because of incomplete cleaning or the like.

Meanwhile, in order to prevent the beads-carry-over, it may be suggested to separate the photoconductor and the developer tank during developer discharge. In this case, however, it is required to include a precise separation mechanism that can maintain a constant gap (air gap) between the photoconductor and the developer tank, making the mechanism complex and increasing production costs.

Moreover, if, during developer discharge, the developer tank is rotated while the photoconductor is stopped, the magnetic chain of the developer contacts with a limited part of the photoconductor. The part of the photoconductor that is rubbed by the developer is damaged. As a possible solution for this problem, the transport screw, which discharges the developer, and the development sleeve, which transports the developer to the photoconductor, may be separately driven in the developer tank. However, this mechanism is also complex and expensive.

SUMMARY OF THE INVENTION

The present invention is made in view of the above problems and has as an object to provide (1) an image forming apparatus that can prevents beads-carry-over during developer discharge, (2) a method of controlling the image forming apparatus, (3) a control program, and (4) a recording medium storing the program.

In order to solve the above problem, an image forming apparatus of the present invention includes: development means for developing an electrostatic latent image formed on a photoconductor, using developer including toner and carrier; discharge means for discharging developer from the development means; charging control means for controlling a photoconductor potential that is a surface potential of a face of the photoconductor, which face is opposite to the development means; development bias control means for controlling a development bias potential that is a surface potential of a face of the development means, which face is opposite to the photoconductor; and main control means for controlling the charging control means and the development bias control means so that a potential difference between the photoconductor potential and the development bias potential in developer discharge from the development means is smaller than the potential difference in image forming.

In the above structure, during developer discharge from the development means, the potential difference between the photoconductor potential and the development bias potential is set smaller than that in image forming. Therefore, even when an amount of developer in the development section decreases due to developer discharge, increase of beads-carry-over onto the photoconductor from the development section can be prevented. Accordingly, damage to the photoconductor or image errors due to incomplete cleaning that are caused by beads-carry-over can be prevented.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 1(*a*) is a graph showing photoconductor potentials and development bias potentials, in image forming, of an image forming apparatus according to one embodiment of the present invention.

FIG. 1(*b*) is a graph showing photoconductor potentials and development bias potentials, during developer discharge mode, of an image forming apparatus according to one embodiment of the present invention.

DESCRIPTION OF THE EMBODIMENTS

The following describes embodiments of the present invention.

Image Forming Apparatus 100

Figure 2:
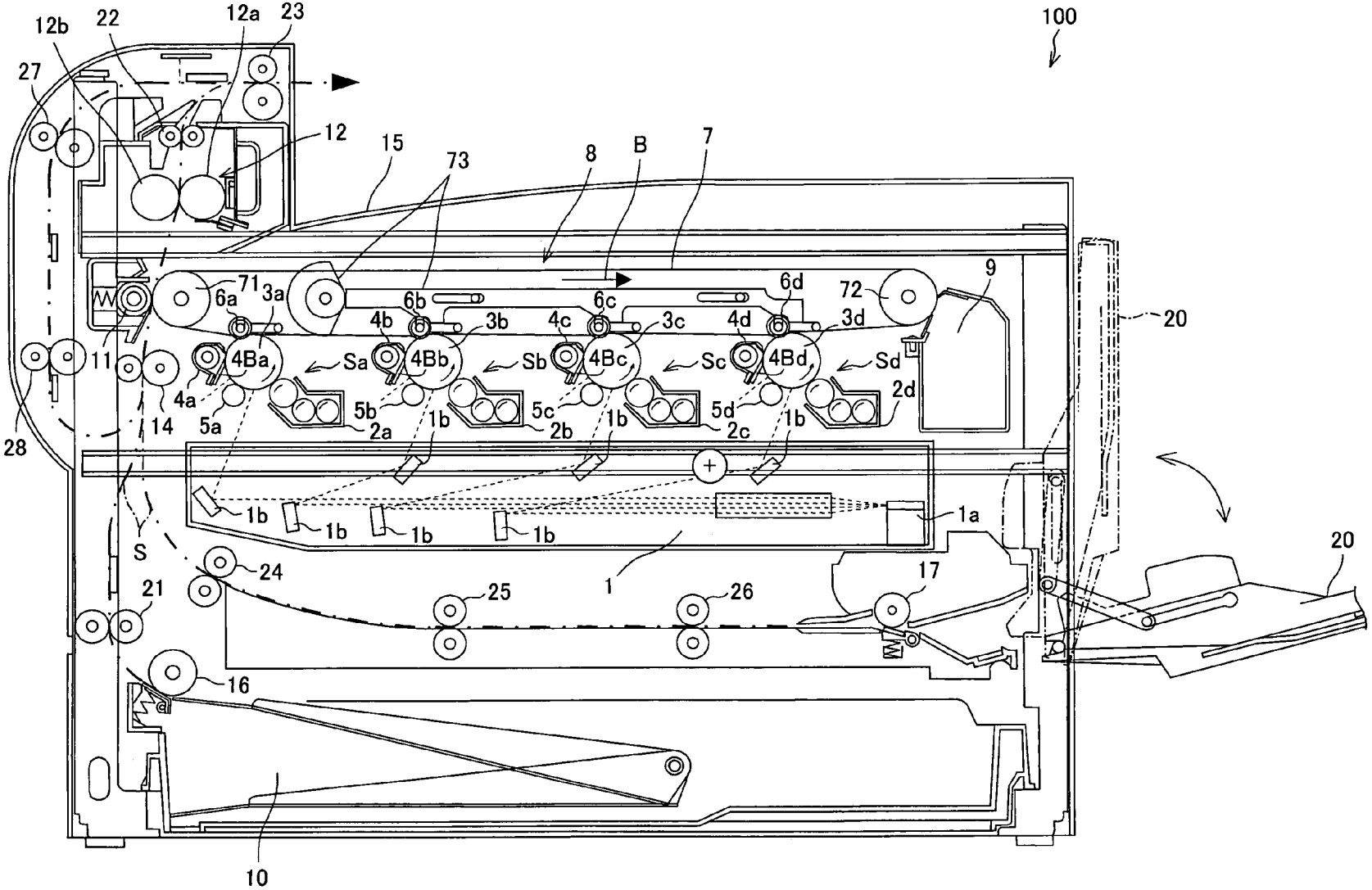
FIG. 2 is a cross sectional view illustrating a schematic structure of an image forming apparatus according to one embodiment of the present invention.

FIG. 2 is a cross sectional view briefly illustrating a structure of an image forming apparatus 100 that is an exemplary image forming apparatus of the present invention. The image forming apparatus 100 adopts a color tandem engine that forms, according to image data supplied from an external device, a multi-color or monochrome image on a recording paper (sheet).

As illustrated in FIG. 2, the image forming apparatus 100 includes an exposure unit 1, development units 2*a*-2*d*, photoconductive drums 3*a*-3*d*, charging units 5*a*-5*d*, cleaning units 4*a*-4*d*, an intermediate transfer belt 7, an intermediate transfer belt unit 8, a fixing unit 12, a paper transport path S, a paper feeding tray 10, a paper ejecting tray 15 and other components. Operation of the components included in the image forming apparatus 100 is controlled by a CPU (controller) that is not illustrated.

The image forming apparatus 100 further includes an operation history storing section 48 (see FIG. 11 described below) and a display section (not illustrated). The operation history storing section 48 stores operation history, such as a number of papers consumed after previous replacement of developer (an accumulated number of recording papers on which images were formed). The display section displays, for example, the operation history.

The image forming apparatus 100 further includes an operation input section (discharge mode set means) 49 (not illustrated). The operation input section accepts an instruction from a user to execute a developer discharge mode, and transmits the instruction to a main control section 101 included in a developer discharge control section (described later). The operation input section may be, for example, so-called a touch-panel by which a user inputs an instruction by touching a selection displayed on the display means. The touch-panel may instead be a keyboard which allows a user to input an instruction by pressing a button corresponding to a selection.

The image forming apparatus 100 processes image data corresponding to a color image using black (K), cyan (C), magenta (M), and yellow (Y). Therefore, as illustrated in FIG. 2, the image forming apparatus 100 includes the development units 2*a*, 2*b*, 2*c*, 2*d*, the photoconductive drums 3*a*, 3*b*, 3*c*, 3*d*, the charging units 5*a*, 5*b*, 5*c*, 5*d*, and the cleaning units 4*a*, 4*b*, 4*c*, 4*d*. Four units per kind are provided so as to form four types of latent images respectively corresponding to the colors K, C, M, Y. The above units form four image stations Sa, Sb, Sc, Sd respectively corresponding to the colors K, C, M, Y. The reference characters "a", "b", "c", "d" correspond to black, cyan, magenta, and yellow, respectively. The image stations Sa-Sd are substantially same in structure.

The photoconductive drums 3*a*-3*d* are disposed in an upper part of the image forming apparatus. The charging units 5*a*-5*d*, the development units 2*a*-2*d*, and the cleaning units 4*a*-4*d* are disposed around the photoconductive drums 3*a*-3*d* in a rotation direction (in a direction of the arrow A illustrated in Figure) of the photoconductive drums 3*a*-3*d*.

The charging units 5*a*-5*d* evenly charge surfaces of the photoconductive drums 3*a*-3*d* at a predetermined potential. The charging units 5*a*-5*d* are each realized by a scorotron type charging unit that includes a sawtooth-shaped discharge electrode, a mesh grid, and a housing for covering the discharge electrode. In the present embodiment, the charging units 5*a*, 5*b*, 5*c*, 5*d* are provided in the image station Sa for black (K), Sb for cyan (C), Sc for magenta (M), and Sd for yellow (Y), respectively.

The charging units 5*a*, 5*b*, 5*c*, 5*d* corresponding to black (K), cyan (C), magenta (M), and yellow (Y), respectively, are identical in shape and each have a housing of 14 mm in width (width in a substantially vertical direction with respect to a direction of rotation shafts of the photoconductive drums 3*a*-3*d*). Further, shapes and operations of the charging units 5*a*, 5*b*, 5*c*, 5*d* are standardized so as to be applicable to various types of image forming apparatuses having different processing speeds.

Further, the charging units 5*a*, 5*b*, 5*c*, 5*d* provided in the image stations Sa, Sb, Sc, Sd, respectively, are supplied with high-voltages from separate high-voltage power supply units (not illustrated). Primary low-voltage switching elements of the high-tension power supply units control ON and OFF of high-tension output that is sent from the high-tension power supply units to the charging units 5*a*, 5*b*, 5*c*, 5*d*.

For example, a contact charging unit, such as a charging roller or a charging brush, may be adopted as the charging units 5*a*, 5*b*, 5*c*, 5*d*.

The exposure unit 1 exposes, according to inputted image data, the photoconductive drums 3*a*-3*d* charged by the charging units 5*a*-5*d* so as to form an electrostatic latent image, according to the image data, on the surfaces of the photoconductive drums 3*a*-3*d*. The exposure unit 1 is realized by a laser scanning unit (LSU) including a laser emitting section 1*a*, a reflection mirror 1*b*, and other components. As the exposure unit 1, for example an EL or an LED writing head in which light emitters are lined in array may be used.

The development units 2*a*-2*d* develop electrostatic latent images formed on the photoconductive drums 3*a*-3*d*. The electrostatic latent images are printed by color toners of K, C, M, and Y.

The cleaning units 4*a*-4*d* are provided with cleaning blades 4Ba-4Bd. By bringing the cleaning blades 4Ba-4Bd into contact with the photoconductive drums 3*a*-3*d*, the cleaning units 4*a*-4*d* remove and collect residual toner on the surfaces of the photoconductive drums 3*a*-3*d* after an electrostatic latent image is developed and transferred.

The intermediate transfer belt unit 8 is disposed above the photoconductive drums 3*a*-3*d*. The intermediate transfer belt unit 8 is provided with intermediate transfer rollers 6*a*-6*d*, the intermediate transfer belt 7, an intermediate transfer belt driving roller 71, an intermediate transfer belt driven roller 72, an intermediate transfer belt tension mechanism 73, and an intermediate transfer belt cleaning unit 9. These components, for example the intermediate transfer rollers 6*a*-6*d*, the intermediate transfer belt driving roller 71, the intermediate transfer belt driven roller 72, and the intermediate transfer belt tension mechanism 73, tense the intermediate transfer belt 7 and rotate it in an arrow-B direction.

The intermediate transfer rollers 6*a*-6*d* are rotatably engaged by an intermediate transfer roller installation section (not illustrated) of the intermediate transfer belt tension mechanism 73 of the intermediate transfer belt unit 8. The intermediate transfer rollers 6*a*-6*d* apply a transfer bias that is used for transferring the toner image formed on the photoconductive drums 3*a*-3*d* to the intermediate transfer belt 7.

The intermediate transfer belt 7 is so disposed as to be in contact with the photoconductive drums 3*a*-3*d*. Each of the color toner images (K, C, M, Y) respectively formed on the photoconductive drums 3*a*-3*d* is transferred and serially layered on the intermediate transfer belt 7, so as to form a color toner image (multi-color toner image) on the intermediate transfer belt 7. The intermediate transfer belt 7 is formed in loop with a film having a thickness of approximately 100 μm to 150 μm. In the case of monochrome printing, only the photoconductive drum 3*a* of black (K) is brought into contact with the intermediate transfer belt 7.

Further, the intermediate transfer belt 7 is so designed as to be separable from the photoconductive drums 3*a*-3*d*. Specifically, a relative positions of the intermediate transfer rollers 6*a*-6*d*, the intermediate transfer belt driving roller 71, the intermediate transfer belt driven roller 72, the intermediate transfer belt tension mechanism 73 and other components in the intermediate transfer belt unit 8 is changed by a driving means (not illustrated), thereby allowing the intermediate transfer belt 7 to be separated from the photoconductive drums 3*a*-3*d*.

The toner images formed on the photoconductive drums 3*a*-3*d* are transferred onto the intermediate transfer belt 7 by the intermediate transfer rollers 6*a*-6*d* that are in contact with a back side of the intermediate transfer belt 7. A high-voltage transfer bias (a high-voltage with an opposite polarity (+) to the charging polarity (−) of toner) is applied to the intermediate transfer rollers 6*a*-6*d* so that the toner image is transferred.

The intermediate transfer rollers 6*a*-6*d* each have a metal (for example, stainless) shaft body with a diameter of 8 mm to 10 mm, and a surface thereof is covered by conductive elastic material (for example, EPDM or urethane foam). The conductive elastic material allows high-voltage to be evenly applied to the intermediate transfer belt 7. In the present embodiment, the intermediate transfer rollers 6*a*-6*d* are used as transfer electrodes, but, for example, brushes may also be used as the transfer electrodes.

As described above, the electrostatic images (toner images) respectively visualized on the photoconductive drums 3*a*-3*d* correspondingly to the colors K, C, M, Y are transferred (layered) onto the intermediate transfer belt 7, so as to form an image corresponding to image information inputted to the apparatus. The image transferred (layered) as described above is shifted by rotation of the intermediate transfer belt 7 to a contact position of the intermediate transfer belt 7 and a recording paper described below. Then, the image is transferred onto the recording paper by a transfer roller 11 provided in the contact position.

At this time, the intermediate transfer belt 7 and the transfer roller 11 are pressed by a predetermined nip (with a predetermined force and width), and voltage is applied to the transfer roller 11 to transfer the toner onto the recording paper (a high-voltage with an opposite polarity (+) to the charging polarity (−) of toner). In order for the transfer roller 11 to have the same nip consistently, it is preferable that one of the transfer roller 11 and the intermediate transfer belt driving roller 71 be made of hard material (such as metal), and the other one be made of soft material, for example an elastic roller (such as elastic rubber roller or a resin foam roller).

Further, as described above, the intermediate transfer belt cleaning unit 9 collects and removes toner that was adhered to the intermediate transfer belt 7 when the photoconductive drums 3*a*-3*d* were in contact with the intermediate transfer belt 7. The intermediate transfer belt cleaning unit 9 also collects and removes residual toner on the intermediate transfer belt 7 that was not transferred onto the recording paper by the transfer roller 11. The toner and the residual toner are removed because they may cause mixture of colors in a subsequent process.

The intermediate transfer belt cleaning unit 9 is provided with, for example, a cleaning blade that functions as a member (cleaning member) in contact with the intermediate transfer belt 7. In this case, the intermediate transfer belt 7 is engaged, from the back side, by the intermediate transfer belt driven roller 72 at a position where the intermediate transfer belt 7 contacts with the cleaning blade.

Recording papers (recording sheets) used for image forming are stacked on the paper feeding tray 10 that is disposed below the exposure unit 1 of the image forming apparatus 100. Further, the paper ejecting tray 15 is disposed at an upper part of the image forming apparatus 100. A recording paper with a printed image is placed thereon with a printed side facing downward. Further, a manual paper feeding tray 20 is a foldaway tray disposed on a side wall of the image forming apparatus 100. The manual paper feeding tray 20 allows a recording paper to be manually fed from a lateral side of the image forming apparatus 100.

The image forming apparatus 100 further includes a paper transport path S having a substantially vertical shape. Through the paper transport path S, a recording paper is shifted from the paper feeding tray 10 to the paper ejecting tray 15 via the transfer roller (transfer section) 11 and the fixing unit 12. Further, in a vicinity of the paper transport path S from the paper feeding tray 10 and the manual paper feeding tray 20 to the paper ejecting tray 15, pick up rollers 16 and 17, a registration roller 14, a transfer roller 11, a fixing unit 12, transport rollers 21-28 for transporting a recording paper, and other components are disposed.

The transport rollers 21-26 are small rollers used to facilitate and engage transporting recording papers. A plurality of transport rollers 21-26 are disposed along the paper transport path S. The transport rollers 27 and 28 transport a recording paper having a printed image on one side, for double-side printing, to the registration roller 14 through a reversed-paper ejecting path of the paper transport path S, which reversed-paper ejecting path is disposed beside the fixing unit 12. This reverses the recording paper so as to carry out printing on the other side.

The pick up roller 16 is disposed at an end section of the paper feeding tray 10, from which a recording paper is supplied to the paper transport path S. The pick up roller 17 is disposed at another end section of the manual paper feeding tray 20, from which a recording paper is supplied to the manual paper feeding tray 20. The pick up roller 16 is a guide roller that feeds a recording paper one by one from the paper feeding tray 10 to the paper transport path S, while the pick up roller 17 is a guide roller that feeds a recording paper one by one from the manual paper feeding tray 20 to the paper transport path S.

The registration roller 14 temporarily holds a recording paper being shifted through the paper transport path. The registration roller 14 transports the recording paper to the transfer roller 11 at a timing when the front end of the toner image on the intermediate transfer belt 7 meets the front end of the recording paper.

The fixing unit 12 includes a heat roller 12*a*, a pressure roller 12*b* and other components. The heat roller 12*a* and the pressure roller 12*b* are rotated, and the recording paper is shifted between the rotating heat roller 12*a* and the rotating pressure roller 12*b*.

Further, the heat roller 12*a* is controlled to have a predetermined fixing temperature in accordance with a signal from a temperature detector (not illustrated). By fusing, mixing, and pressing the toner image (multi-color toner image or monochrome toner image) transferred onto the recording paper, the heat roller 12*a* and the pressure roller 12*b* fix the toner image, so that the toner image is thermally fixed to the sheet.

After the multi-color toner image is fixed on the recording paper, the recording paper is shifted to the reversed-paper ejecting path of the paper transport path S by the transport rollers 22 and 23. Then, the recording paper is reversed (the toner image facing downward) and ejected on the paper ejecting tray 15.

The image forming apparatus 100 according to the present embodiment uses developer including magnetic particle carrier and non-magnetic toner that are agitated so as to be charged by friction and be electrostatically attached to each other (two-component developer).

Figure 3:
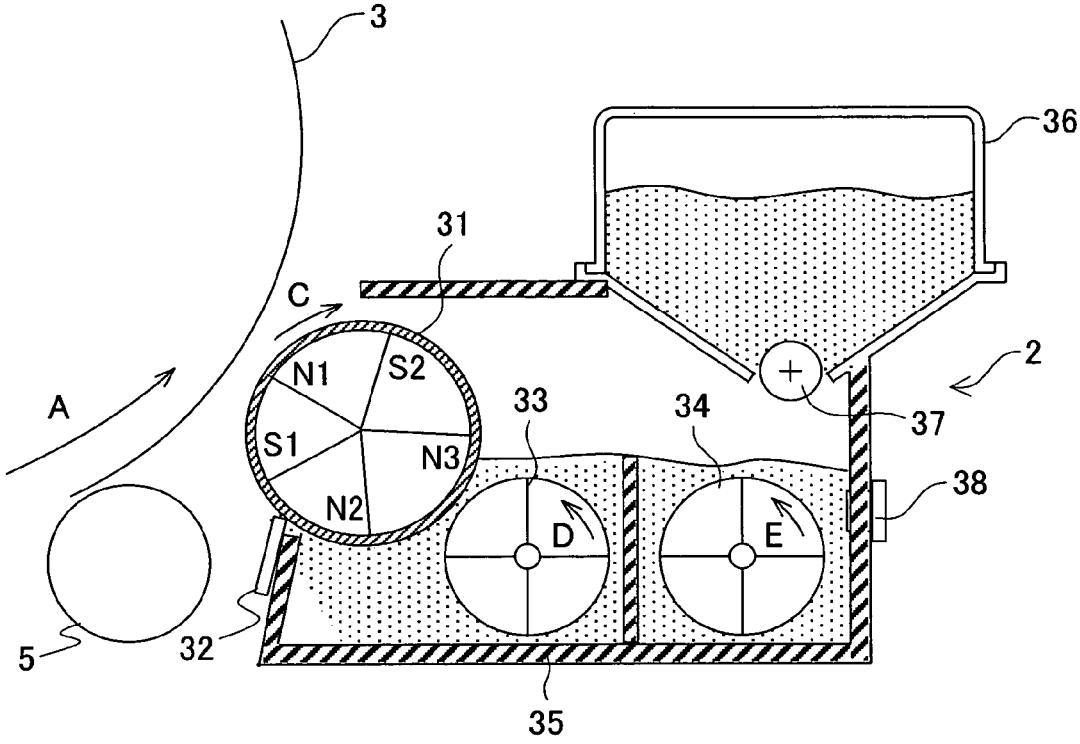
FIG. 3 is an explanatory view schematically illustrating a relationship among a photoconductive drum, a charging unit, and a development unit in an image forming apparatus according to one embodiment of the present invention.

FIG. 3 is a descriptive diagram schematically illustrating a relationship among the photoconductive drum 3, the charging unit 5, and the development unit 2 in the image forming apparatus 100. As mentioned above, the photoconductive drums 3*a*-3*d* are substantially the same in structure. Accordingly, hereinafter, the photoconductive drums 3*a*-3*d* will be referred to as a photoconductive drum 3. In the same manner, the development units 2*a*-2*d* will be referred to as a development unit 2, and the charging units 5*a*-5*d* will be referred to as a charging unit 5.

As illustrated in the Figure, the development unit 2 includes a development sleeve (development roller, that is, developer transport means) 31, a doctor blade 32, transport screws 33 and 34, a developer tank (housing) 35, a toner supply tank 36, and a toner supply screw 37. Further, in a lower part of the development unit 2 is disposed a waste developer collecting unit 50 that is constituted of a developer discharge port 200*a*, a discharge port shutter 210, a collecting container installation section 220, and a collecting container 300 (see FIGS. 4 to 10 described below). Further, a developer discharge control section 40 (see FIG. 11 described below) is included in the image forming apparatus 100. The developer discharge control section 40 controls operation of the photoconductive drum 3, the charging unit 5, the development unit 2 and other components during waste developer discharge (developer discharge mode).

The developer tank 35 is a container tank for storing developer. On a side face of the developer tank 35 is disposed a developer density sensor (toner density sensor) 38. The developer tank 35 is provided with an aperture. Through the aperture, developer is supplied from the toner supply tank 36. In the image forming apparatus 100, a control section (not illustrated), such as a CPU, controls rotation of the toner supply screw 37 in accordance with a detection result by the developer density sensor 38, thereby controlling the amount of toner to be supplied to the developer tank 35. The developer tank 35 is further provided with an additional aperture. From this additional aperture, a part of the development sleeve 31 is exposed. Further, the developer density sensor 38 also has a function of detecting, based upon the detection result in relation to the developer density, a liquid surface level of the developer in the developer tank 35.

The toner supply tank 36 is provided with a toner supply screw 37. The toner supply screw rotates so that a predetermined amount of toner is supplied from the toner supply tank 36 to the developer tank 35.

The transport screws (agitation screws) 33 and 34 agitate the developer in the developer tank 35 so that the developer is slightly charged and is shifted to the development sleeve 31.

The doctor blade 32 sets a doctor gap, which is a gap between the development sleeve 31 and a front end of the doctor blade 32, to a prescribed value. The doctor blade 32 cuts a part of toner chains adhered on the development sleeve 31. The doctor blade 32 is disposed on the developer tank 35 at an upstream part with respect to a nip section formed by the development sleeve 31 and the photoconductive drum 3 (upstream part in a rotation direction of the development sleeve 31).

The development sleeve 31 draws developer from the developer tank 35 and transport the developer to the surface of the photoconductive drum (or the opposite face to the photoconductive drum). In other words, the development unit 2 according to the present embodiment adopts a draw development method.

The development sleeve 31 is formed as a rotatable cylinder, and a part of an outer surface thereof is exposed through the aperture of the developer tank 35 in such a way as to be opposite to the photoconductive drum 3. Further, a fixing magnet is disposed in the development sleeve 31. The fixing magnet is a combination of a plurality of magnets each having different magnetism. The fixing magnet disposed in the development sleeve 31 forms, in a vicinity of the outer surface of the development sleeve 31, a transport start pole N2, a transport pole S1, a developer supply pole N1, a transport pole S2, and a release pole N3 in a rotation direction (direction indicated by the arrow C) of the development sleeve.

At least a part of the transport start pole N2 comes below a liquid surface level of the developer when the developer tank 35 is filled with a predetermined amount of developer required for adequate development of an electrostatic latent image formed on the photoconductive drum 3 (in other words, the liquid surface level is a surface level before developer discharge is executed). With this structure, the developer sleeve 31 draws developer from the level below the liquid surface level, which is a surface level of the developer before developer discharge is executed, and supplies the developer onto the photoconductive drum 3.

The photoconductive drum 3 is disposed opposite to the developer supply pole N1 in the development sleeve 31. The transport screw 34 is disposed opposite to the release pole N3 in the development sleeve 31. The doctor blade 32 resides at substantially the midpoint of the transport start pole N2 and the transport pole S1.

The photoconductive drum 3 and the development sleeve 31 are so mounted as to be rotatable by driving means (not illustrated), which will be realized by a motor or the like. Upon general image forming (when an electrostatic latent image on the photoconductive drum 3 is developed), the development sleeve 31 is driven at a predetermined peripheral speed, which is 1.3 to 2.5 times faster than that of the photoconductive drum 3.

Waste Developer Collecting Unit 50

The following describes in detail a waste developer collecting unit 50 that is provided to the image forming apparatus 100 of the present invention.

First of all, a structure of the waste developer collecting unit 50 will be described. The waste developer collecting unit 50 is constituted with a part of the development unit 2 and a collecting container 300 that is illustrated in FIGS. 4 and 5.

Figure 4:
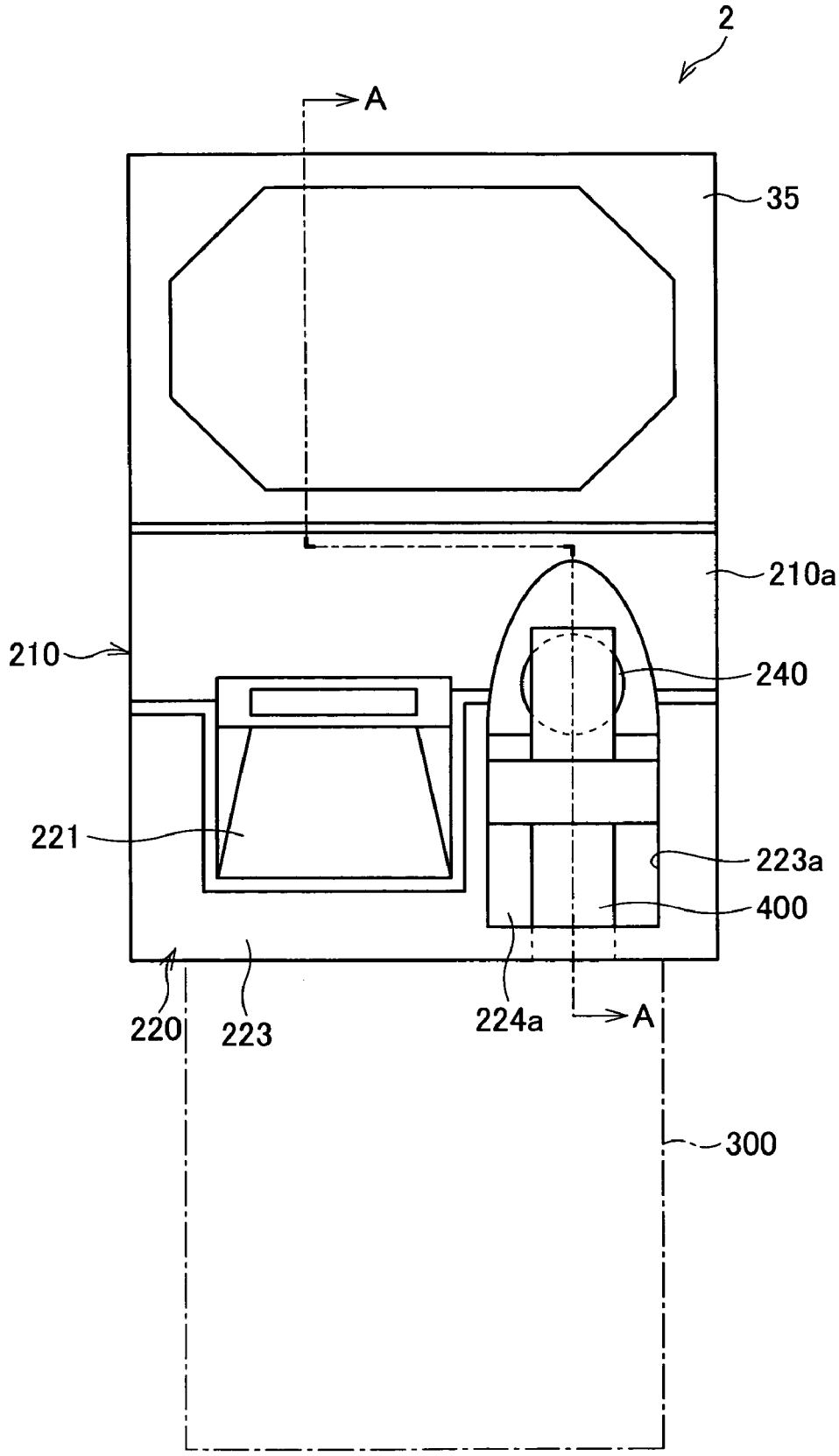
FIG. 4 is a front view illustrating an exterior of a development unit included in an image forming apparatus according to one embodiment of the present invention.

FIG. 4 is a front view illustrating an exterior of the development unit 2. FIG. 4 illustrates a front face of the developer unit 2. The "front face" indicates an operation side of the image forming apparatus 100 where the user stands to operate the apparatus. A front face of the image forming apparatus 100 is provided with a door. When the door is opened for the purpose of, for example, maintenance, the development unit 2 is exposed. FIG. 5 is a cross sectional view, taken along the arrow A-A in FIG. 4.

Figure 5:
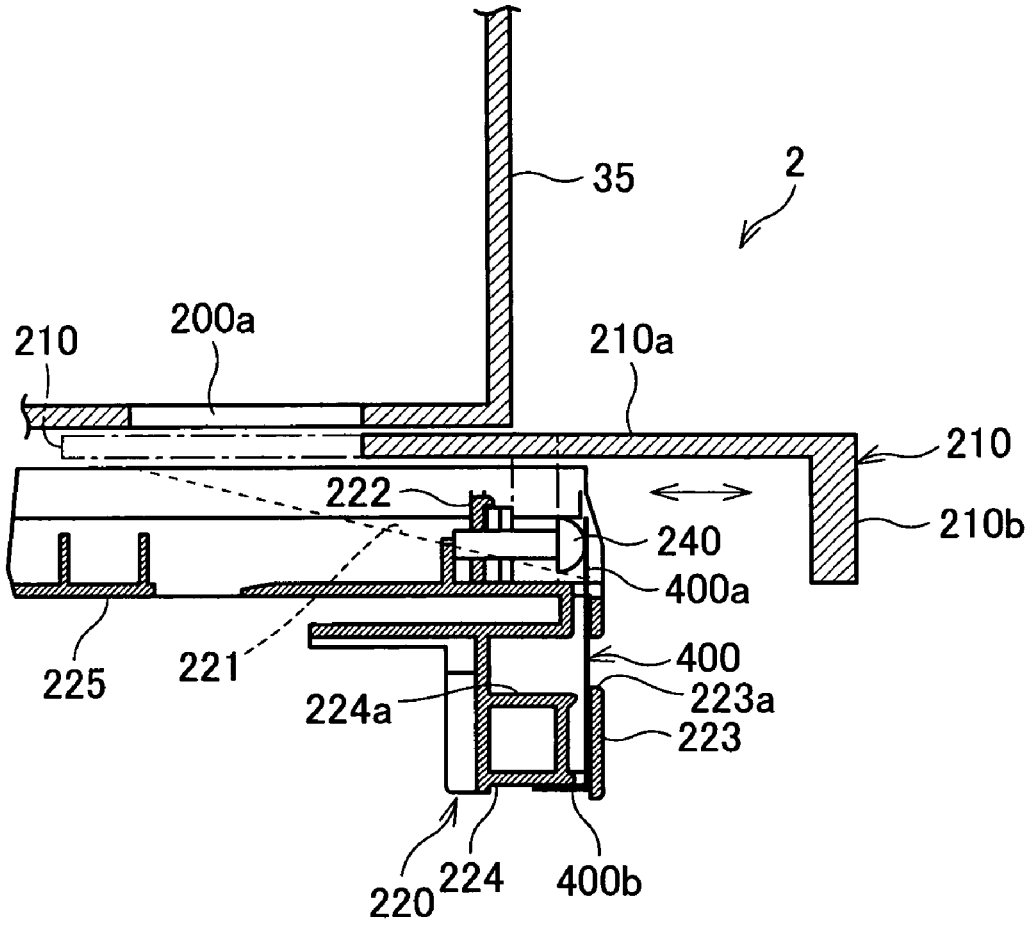
FIG. 5 is a cross sectional view, taken along the line A-A of the development unit of FIG. 4.

As illustrated in FIGS. 4 and 5, below the developer tank 35 in the development unit 2 are disposed a discharge port shutter 210 and a collecting container installation section 220.

The discharge port shutter 210 functions as opening/closing means, and includes a flat section 210*a* and a front face section 210*b*. The discharge port shutter 210 is disposed such that the discharge port shutter 210 can be pulled out or stored into a direction indicated by the arrow in FIG. 5.

The flat section 210*a* is formed as a plate that horizontally extends. When the development unit 2 is used in a normal mode (general image formation), as indicated by a chain line illustrated in FIG. 5, the flat section 210*a* is moved to shut the developer discharge port 200*a* disposed at the bottom of the developer tank 35, thereby preventing the developer from leakage. The developer discharge port 200*a* is formed on the front side of the bottom surface of the development unit 2. Thus, the developer discharge port 200*a* is closely disposed to where the collection container 300 described below is to be mounted. This allows a discharge slope 221 described below to be largely inclined, facilitating developer discharge.

The front face section 210*b* is disposed on the front face side of the development unit 2. The front face section 210*b* vertically extends downward from the flat section 210*a*. A lower end of the front face section 210*b* is slightly above the aperture 223*a* of a front wall (opening wall section) 223 described below, avoiding the opening of the aperture 223*a*.

The collecting container installation section 220 functions as a collecting container fixing means and is disposed, as a part of the development unit 2, under the flat section 210*a* in the development unit 2. The collecting container installation section 220 is provided with a discharge slope 221, a discharge port shutter holding section 222, a front wall 223, a collecting container holding section 224, and a base section 224.

The base section 225 is disposed parallel to the bottom face of the development unit 2, below the bottom face and the flat section 210*a*. Although not illustrated in Figure, the base section 225 is fixed to the development unit 2.

The discharge slope 221 is disposed at an upper part of the base section 225. The discharge slope 221 includes a slope face extending from a backmost end of the developer discharge port 200*a* to the front face side of the collecting container installation section 220. The waste developer discharged from the developer discharge port 200*a* is guided through this discharge slope 221 to the outside of the development unit 2. When the developer discharge port 200*a* is shielded by the discharge port shutter 210 (in the state indicated by the chain line), the aperture end section (on the front face side) of the discharge slope 221 is covered by the front face section 210*b*.

The discharge port shutter holding section 222 is provided to the base section 225 and includes a hole (not illustrated) with which the fixing bis 240 functioning as the fixing means is fitted. Pressing the front face section 210*b* by its head, the fixing bis 240 is fitted into the discharge port shutter holding section 222, so as to be fixedly engaged by the collecting container installation section 220, in the state where the developer discharge port 200*a* is shielded by the discharge port shutter 210.

The front wall 223 is formed slightly below the aperture end section of the discharge slope 220*a*. The front wall 223 has an aperture 223*a* next to the aperture end section of the discharge slope 221. A front end section 302*a* (see FIGS. 6 and 7) of a claw 302 (both of which will be described below) of the collecting container 300 is inserted into the aperture 223*a*. Because of the aperture 223*a* and the discharge slope 221 next to each other, the lower portion of the collecting container installation section 220 have a compact form.

The collecting container holding section 224 is disposed below a lower end of the base section 225. A certain gap (space) is reserved between the front wall 223 and the collecting container holding section 224. The collecting container holding section 224 is provided with a concave section 224*a* having an aperture where the aperture 223*a* is formed.

In the gap between the front wall 223 and the collecting container holding section 224, the bis shielding member 400 is provided in the rear side of the aperture 223*a*. The bis shielding member 400 functions as fixing/releasing means and is constituted with a thin and long main body 400*a*, and a fixing section 400*b* that extends from the lower part of the main body 400*a* in a vertical direction of the main body 400*a*. The main body 400*a* extends straights so that the upper end thereof covers the head of the fixing bis 240, while being exposed from the front wall 223. This enables the bis shielding member 400 to shield the head of the fixing bis 240 in the state where the claw 302 is separated from the aperture 233*a*. Further, the fixing section 400*b* is fixed to a bottom surface of the collecting container holding section 224. The bis shielding member 400 functions as a flexible member. Therefore, it is preferable that the bis shielding member 400 be thin (for example in a film shape with a thickness of 0.1 to 0.3 mm) and made of flexible material, such as polyethyleneterephthalate film (for example, Mylar™ (product name) of the DuPont)), so that the shape of the bis shielding member 200 can be easily deformed by external force.

Figure 6:
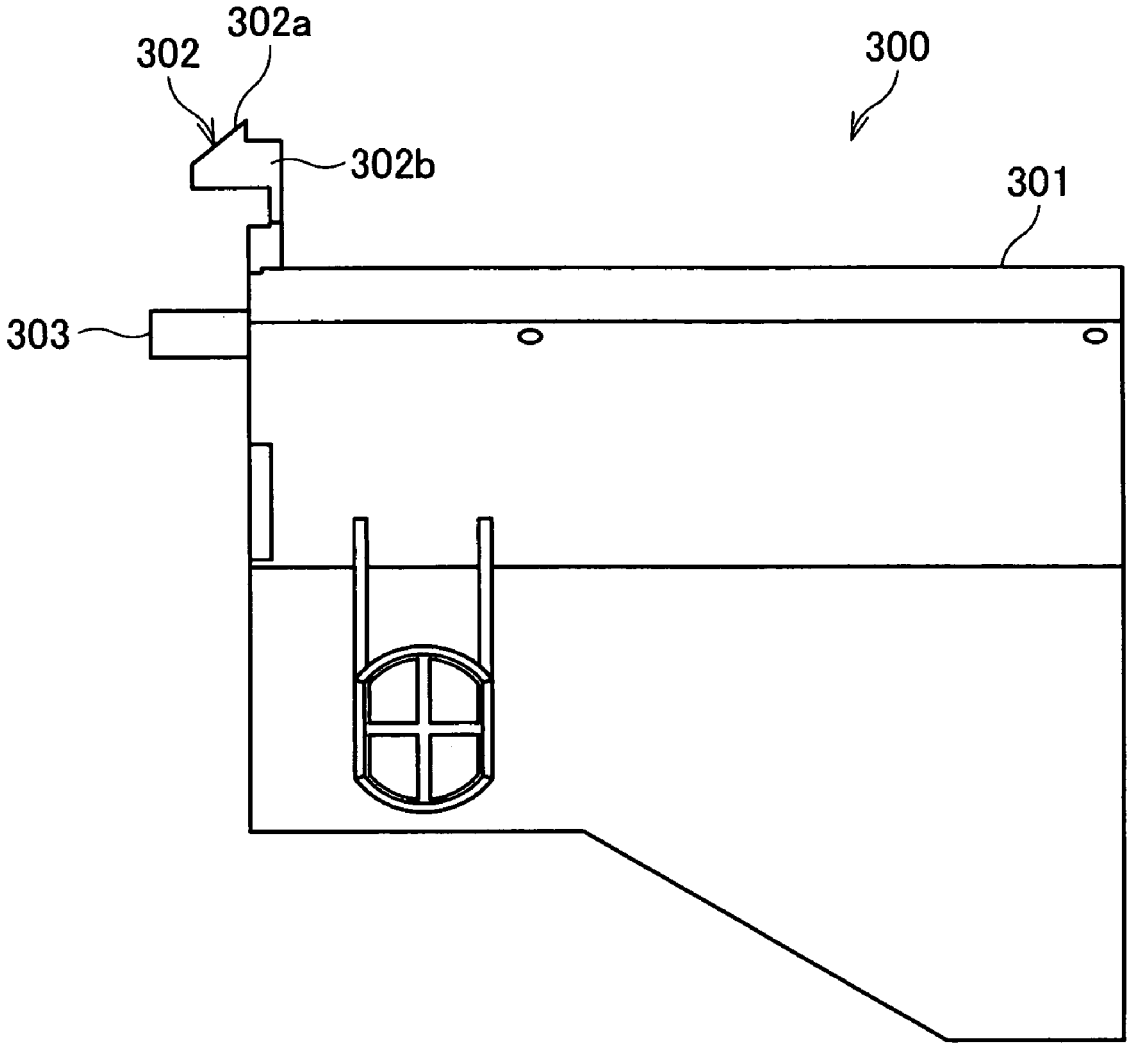
FIG. 6 is a side view illustrating a structure of a collecting container included in an image forming apparatus according to one embodiment of the present invention. The collecting container is used during developer discharge to collect the discharged developer.
Figure 7:
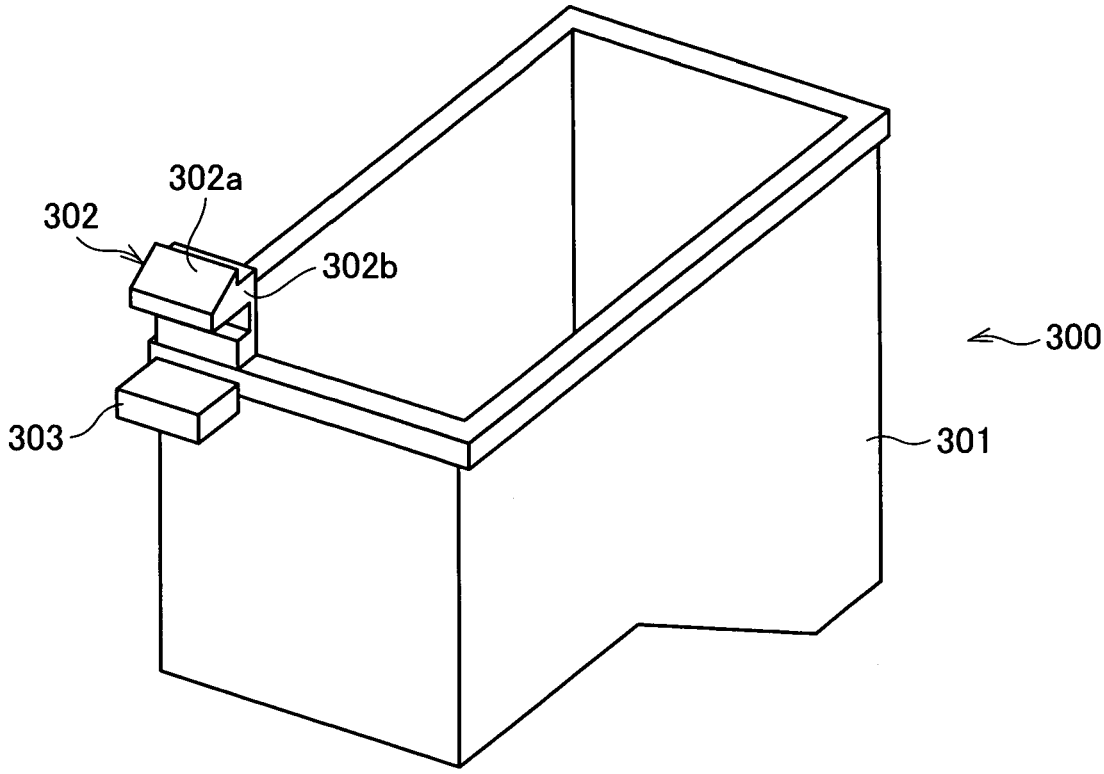
FIG. 7 is a perspective view of the collecting container of FIG. 6.
Figure 8:
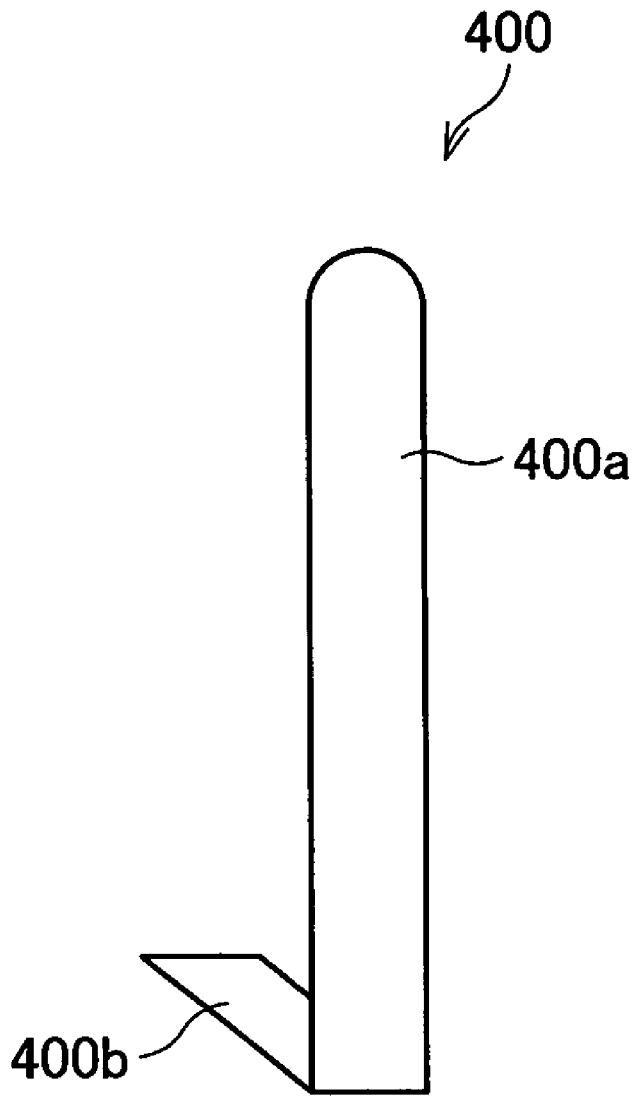
FIG. 8 is a perspective view illustrating a structure of a bis shielding member mounted in the development unit of FIG. 4.

FIG. 6 is a side view illustrating a structure of the collecting container 300, and FIG. 7 is a perspective view illustrating a structure of the collecting container 300.

As illustrated in FIGS. 6 and 7, the collecting container 300 includes a container main body 301 for storing waste developer. The container main body 301 is made as a box and has an opened top. Further, a claw 302 and a contact section 303 are disposed on an upper end section of a side face of the container main body 301, from which side face the container main body 301 is mounted on the collecting container installation section 220.

The claw 302 functions as a connection section for the collecting container 300 and is constituted of a front end section 302*a* and a engaging section 302*b*. The front end section 302*a* is positioned so that it can be engaged (connected) with the aperture 223*a* (described above), while allowing the waste developer discharged from the discharge slope 221 to pass through along its lateral side, in the state where the collecting container 300 is combined the collecting container installation section 220 by being fixed to a lower part of the development unit 2. Further, the front end section 302*a* has a hook (protrusion)-shaped projecting upper end, allowing the front end section to be engaged by inner end faces of the front wall 223, i.e., periphery of the aperture 223*a*. Further, to facilitate smooth insertion of the front end section 302*a* into the aperture 223*a*, the front part of the front end section 302*a* is sloped. Further, the claw 302 has moderate flexibility so as to facilitate insertion and removal of the front end section 302*a* into/from the aperture 223*a* and also to ensure sufficient strength to hold the collecting container 300.

The engaging section 302*b* includes a flat section that horizontally extends from the front end section 302*a*, and a vertical section that extends downward from the flat section. The flat section (cross sectional shape) has a certain thickness so that the flat section can be exposed through the aperture 223*a*.

With this structure, the claw 302 serves to push the bis shielding member 400 into the concave section 224*a*, and also serves to fix the collecting container 300 to the collecting container installation section 220. This makes it possible to improve wearability for the collecting container 300 to be mounted on the main body of the image forming apparatus 100, and prevent the collecting container 300 from detaching from the image forming apparatus 100 due to the weight of the collecting container 300 or the weight of developer.

Figure 9:
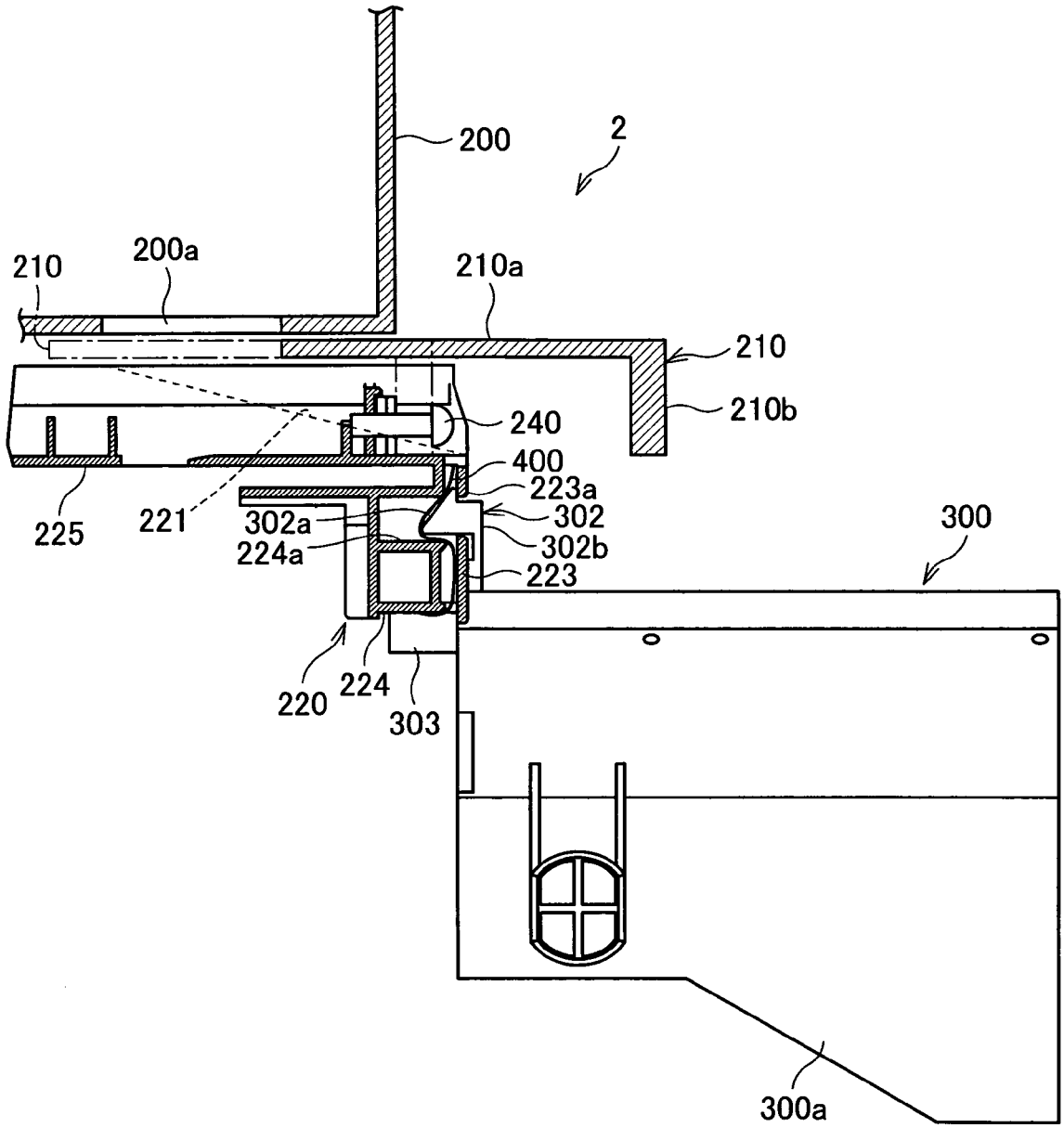
FIG. 9 is a partial cross sectional view illustrating the collecting container of FIG. 4 that is mounted on the development unit illustrated in FIG. 6.

The contact section 303 is disposed slightly below the lower end of the claw 302. The contact section 303 has a quadrate shape and is projected from the container toward the same direction as the direction toward which the front end section on the side of the claw 302 is projected to the aperture 223*a*. Further, as illustrated in FIG. 9, the contact section 303 is formed so as to allow itself to be inserted in the concave section 224*a* in the state where the contact section 303 is in contact with the bottom surface of the collecting container holding section 224. FIG. 9 is a partial cross sectional view illustrating the collecting container 300 mounted on the development unit 2.

The following describes a discharge method of waste developer by the waste develop collecting unit 50. First of all, prior to waste developer discharge, the development unit 2 having a foregoing structure is installed on the image forming apparatus 100. Then, the collecting container 300 is mounted thereto.

As illustrated in FIG. 9, to mount the collecting container 300, the front end section 302*a* of the claw 302 is inserted into the concave section 224*a* through the aperture 223*a*. The top end of the front end section 302 is engaged with the periphery of the aperture 223*a* that is on the inner end surface of the front wall 223 with the bottom surface of the flat section of the engaging section 302*b* in contact with the top end periphery of the aperture 223*a* of the front wall 223. Therefore, the claw 302 is fixed (connected to) on the front wall 223. When the claw 302 is thus fixed, the contact section 303 is in contact with the bottom surface of the collecting container holding section 224.

Consequently, the claw 302 and the contact section 303 catch the collecting container holding section 224 therebetween, thereby fixing the collecting container 300 on the collecting container holding section 224. At this time, the bis shielding member 400 is pushed into the concave section 224*a* by the front end section 302. Consequently, the top end of the bis shielding member 400 is pulled downward, and the head of the fixing bis 240 is exposed.

When the fixing bis 240 is removed, releasing the discharge port shutter 210, the discharge port shutter 210 that is now moveable is pulled. This opens the developer discharge port 200*a*, providing a discharge path which allows waste developer to flow from the development unit 2 to the collecting container 300.

Figure 10:
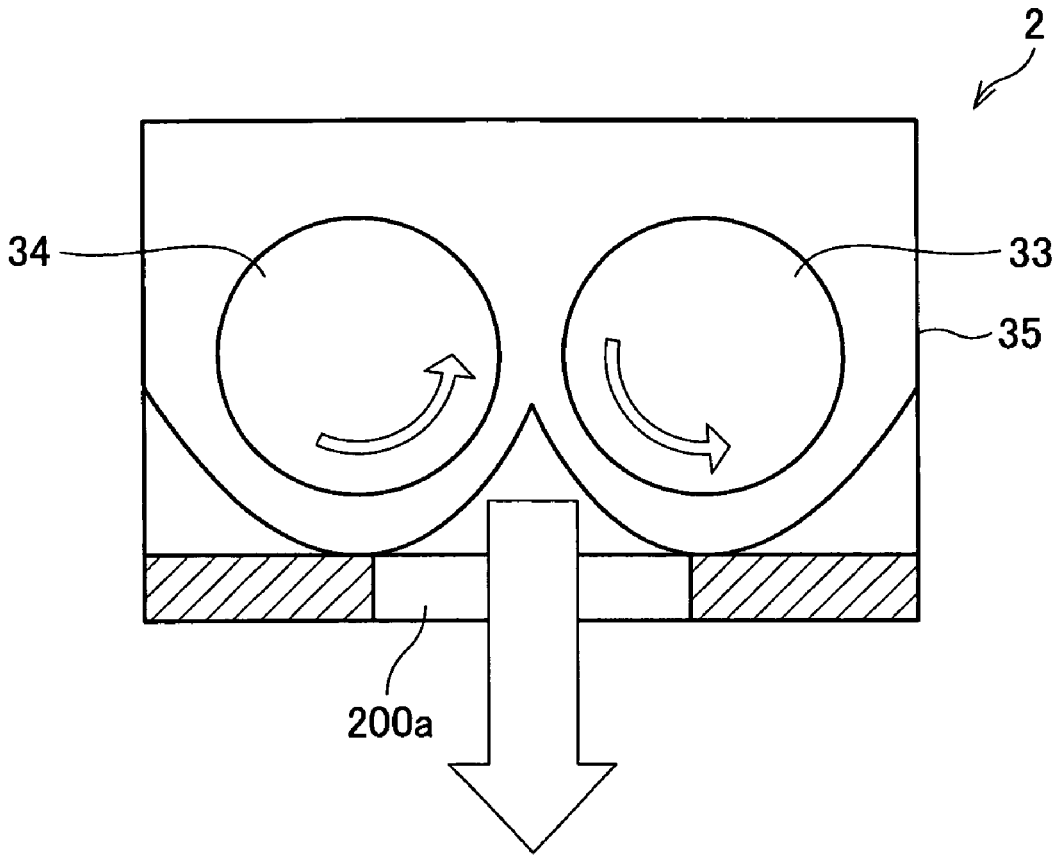
FIG. 10 is an explanatory view of operation of the development unit of FIG. 4 during the developer discharge mode.

At this time, the development unit 2 is started idling (the unit is actuated but no developer is supplied to the photoconductive drums 3*a*-3*d*; (this state is refereed to as a developer discharge mode and will be described later)), as illustrated in FIG. 10. Here, the transport screws 33 and 34 disposed in the developer tank of the development unit 2 are rotated, so that the developer is circulated in the developer tank 35 while being agitated. When the developer shifted and circulated by the transport screws 33 and 34 reaches the bottom of the development unit 2, the developer is discharged from the developer discharge port 200*a*, flows along the discharge slope 221, and is collected by the collecting container 300. Then, the discharge and collection of the waste developer is finished.

Structure of Developer Drain Control Section 40

When waste developer is discharged, developer is shifted onto the development sleeve (MG) 31 by the transport pole N2. If the amount of developer in the developer tank 35 decreases, the height of the surface of the developer in the developer tank 35 gradually becomes lower. Consequently, the amount of developer shifted onto the development sleeve 31 decreases due to decrease of magnetic suction force of the transport pole N2. Meanwhile, the magnetic force of the development sleeve 31 causes the carriers to form a chain constituted of carrier and toner, and the chain is retained on the development sleeve 31. When the chains are brought into contact with the photoconductive drum 3, a carrier is physically and electrostatically disconnected from the chains. At this time, if the congestion of the magnetic chains is high, the separated carrier can be magnetically collected by a neighboring magnetic chain. On the other hand, if the congestion of the magnetic chains is low, there would be a fewer number of neighboring magnetic chains for magnetically collecting the separated carrier, and therefore the carrier released from the magnetic retention moves to the photoconductive drum 3, resulting in the beads-carry-over.

As described above, in the conventional image forming apparatus, beads-carry-over from the development sleeve 31 onto the photoconductive drum 3 becomes significant with the decrease in amount of developer in the developer tank 35 as a result of discharge of developer from the developer tank 35, along.

Figure 11:
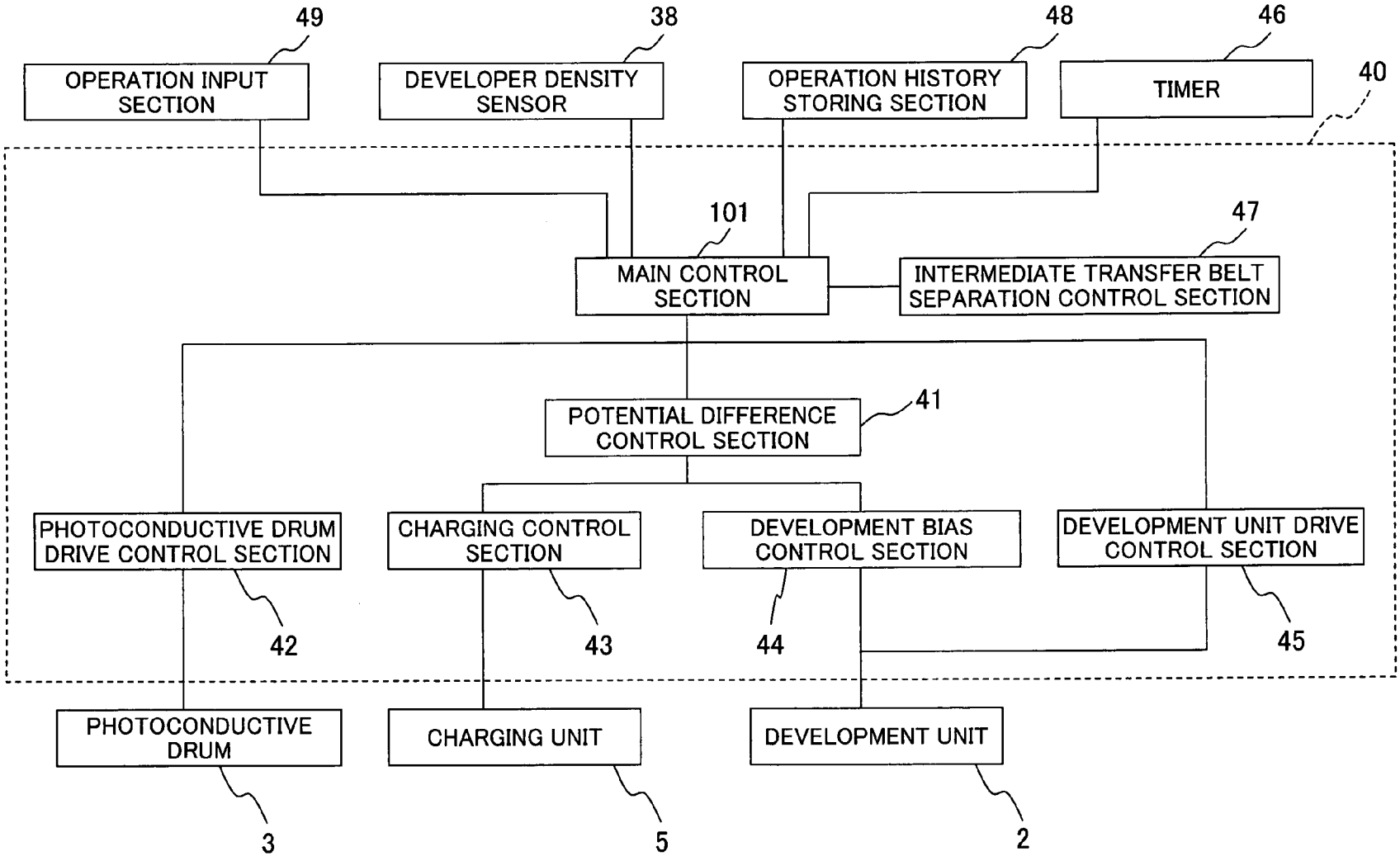
FIG. 11 is a block diagram illustrating a structure of a developer discharge control section included in an image forming apparatus of an embodiment of the present invention.

In order to prevent such beads-carry-over during the developer discharge, the image forming apparatus 100 includes a developer discharge control section 40 (see FIG. 11). The developer discharge control section 40 controls operation of the image forming apparatus 100 during developer discharge (developer discharge mode).

FIG. 11 is a block diagram illustrating a schematic structure of the developer discharge control section 40. As illustrated therein, the developer discharge control section 40 includes a main control section 101, a potential difference control section 41, a photoconductive drum drive control section 42, a charging control section 43, a development bias control section 44, a development unit drive control section 45, and an intermediate transfer belt separation control section 47.

The main control section 101 is a pivotal part of the developer discharge control section 40, administrates the all control operations of the developer discharge control section 40. The main control section 101 is connected to a timer 46. The timer 46 measures an elapsed time since the developer discharge mode is selected or since the developer discharge is started, allowing the main control section 101 to the elapsed time. Further, the main control section 101 receives a signal from the developer density sensor 38, which signal corresponds to a result of measurement of density of the developer in the developer tank 35. Further, the main control section 101 is connected to the operation history storing section 48, and serves to reset the operation history stored in the operation history storing section 48.

The main control section 101 may be either separated or unified from/to the CPU (control section) of the image forming apparatus 100, which CPU controls the entire operation of the image forming apparatus 100.

The potential difference control section 41 controls, according to instruction from the main control section 101, the charging control section 43 and the development bias control section 44, so that the photoconductor potential and the development bias potential are adjusted.

The photoconductive drum drive control section (photoconductor driving control means) 42 controls, according to an instruction from the main control section 101, the motors or other components that actuate and rotate the photoconductive drum 3 (photoconductor driving means). The rotation of the photoconductive drum 3 is thus controlled.

The charging control section 43 controls, according to an instruction from the main control section 101, the movement of the charging unit 5, so as to control the photoconductor potential.

The development bias control section 44 controls, according to an instruction from the main control section 101, the surface potential (development bias potential) of the development sleeve 31.

The development unit drive control section (developer transport drive control means) 45 controls, according to an instruction from the main control section 101, a motor or other components (developer transport drive means) that actuate and rotate the development sleeve 31 and the transport screws 33 and 34, all of which are included in the development unit 2. By doing so, the development unit drive control section controls driving condition of the development unit 2, that is, rotation driving conditions for the development sleeve 31 and the transport screws 33 and 34.

The intermediate transfer belt separation control section 47 controls, according to an instruction from the main control section 101, the driving means for separating the intermediate transfer belt 7 from the photoconductive drums 3*a*-3*d*, so as to separate the intermediate transfer belt 7 from the photoconductive drum 3.

Operation of the developer Drain Control Section 40

The following describes in detail operation of the developer discharge control section 40, that is, the developer discharge method of the present invention. Described first is how to control the photoconductor potential and the development bias potential in the developer discharge mode (developer discharge mode of the present invention adopting reversal development), with reference to FIGS. 1(*a*) and 1(*b*).

FIG. 1(*a*) is a graph showing a relationship, in image forming, between the photoconductor potential (surface potential of an opposite surface of the photoconductive drum 3 to the development sleeve 31) and the development bias potential (surface potential of an opposite surface of the development sleeve 31 to the photoconductive drum 3; development potential). FIG. 1(*b*) is a graph showing a relationship, during developer discharge (developer discharge mode), between the photoconductor potential and the development bias potential.

As illustrated in FIG. 1(*a*), in image forming, the photoconductor potential is set to −600 V, while the development bias potential (development bias voltage) is set to −400 V. In other words, 200V difference (potential difference) is given between the photoconductor potential and the development bias potential. This prevents beads-carry-over or fog in image forming.

On the other hand, during the developer discharge mode, the photoconductor potential and the development bias potential are controlled by the developer discharge control section 40 in the way shown in FIG. 1(*b*). Specifically, when the developer discharge mode is started at a time T1, the photoconductor potential and the development bias potential are increased to the same value as that in image forming mode. In other words, the photoconductor potential is set to −600 V while the development bias potential (development bias voltage) is set to −400 V. Here, the starting time (time T1) of the developer discharge mode denotes the time when the development unit 2 (development sleeve 31, transport screws 33 and 34) is actuated after the instruction to select the developer discharge mode is inputted by a user to the main control section 101 through the operation section (not illustrated).

Here, if there is only a small difference between the photoconductor potential and the development bias potential (for example 0V) immediately after the developer discharge mode is started, it may result in toner carry over (so-called "fog") onto the photoconductive drum 3. Therefore, when magnetic chains of developer on the pole N1 of the development sleeve 31 is sufficient, it is necessary to maintain the difference between the photoconductor potential and the development bias potential at an approximately same level as that during the image forming mode.

Then, at a time T2, the photoconductor potential and the development bias potential are changed such that their difference becomes small. Here, the time T2 is set to a value with which (i) the congestion of the magnetic chains on the development sleeve 31 becomes lower than a predetermined value and (ii) beads-carry-over is increased to a predetermined amount or greater. The predetermined value and the predetermined amount are determined according to characteristics of the developer, the development unit 2, the photoconductor 3 or other components, so as to securely prevent fog and beads-carry-over.

Subsequently, at a time T3, the adjustment of the photoconductor potential and the development bias potential (changing of the potential difference between them) is completed, and the potential difference becomes approximately 0V.

Until a time T4, developer discharge is carried on while maintaining the potential difference of 0V between the photoconductor potential and the development bias potential.

Between the time T3 and the time T4, the amount of developer shifted onto the development sleeve 31 decreases, as the amount of developer in the developer tank 35 decreases. Consequently, the congestion of the magnetic chains becomes low, and the amount of beads-carry-over increases. Therefore, in order to prevent the beads-carry-over, the developer discharge control section 40 sets a small potential difference (potential gap) between the photoconductor potential and the development bias potential.

Then, at the time T4, the developer discharge from the developer tank 35 is finished.

Figure 12:
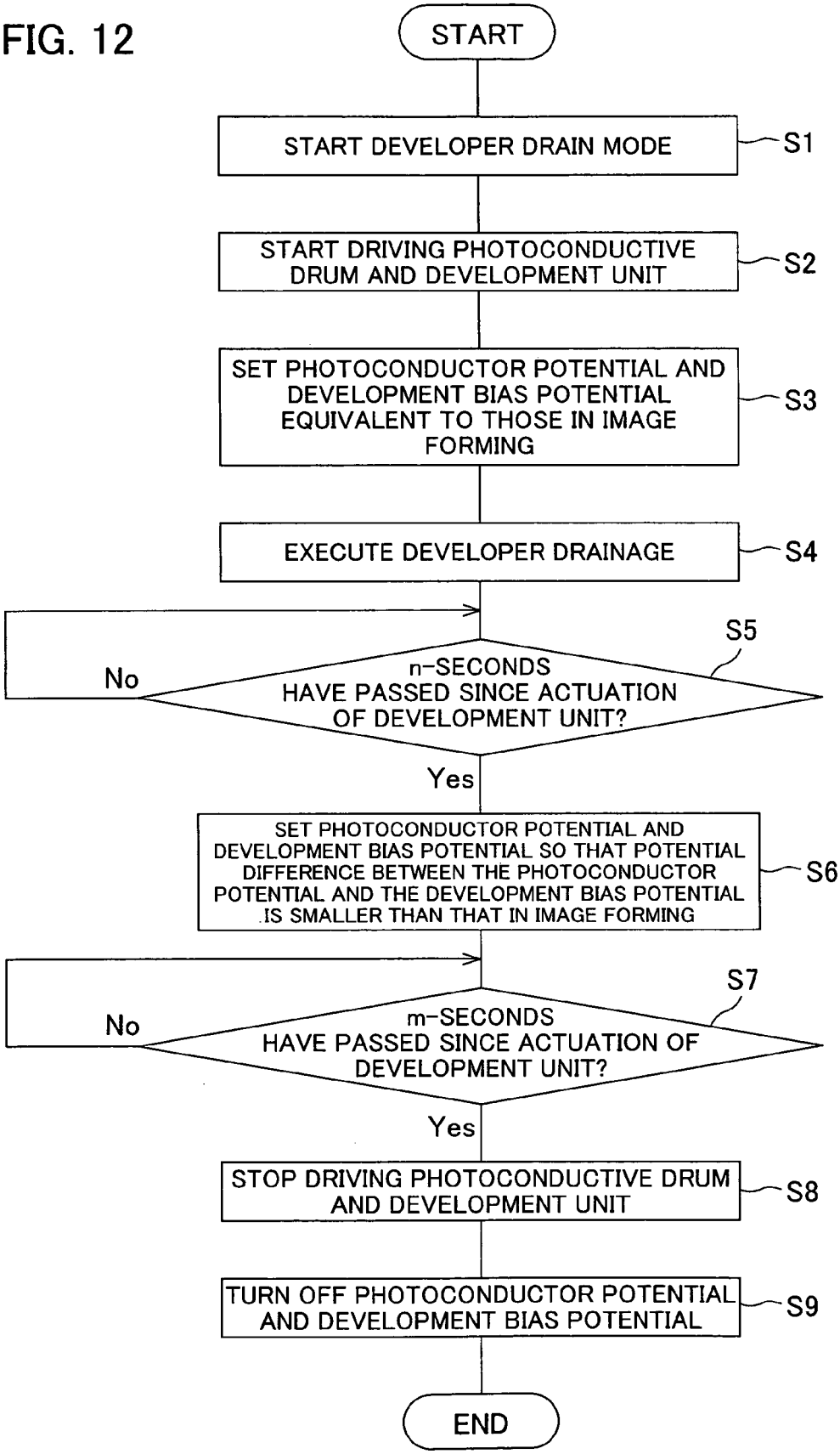
FIG. 12 is a flow chart showing a process sequence carried out by the developer discharge control section of FIG. 11.

The following describes in detail exemplary operation (control method) of the developer discharge control section 40, with reference to the flow chart in FIG. 12.

When the developer discharge mode is executed (selected) (STEP 1), the main control section 101 causes the photoconductive drum drive control section 42 and the development unit drive control section 45 to start driving (rotating) the photoconductive drum 3 and the development unit 2 (development sleeve 31, transport screws 33 and 34) (STEP 2). Here, rotation speeds of the photoconductive drum 3 and the development sleeve 31 are set at substantially same values as that in the image forming mode, respectively. Further, the rotation speeds of the photoconductive drum 3 and the development sleeve 31 are maintained at certain speeds until they are stopped in STEP 8 described below.

Further, the main control section 101 controls the charging control section 43 and the development bias control section 44 via the potential difference control section 41 to cause them to raise the photoconductor potential and the development bias potential to the same levels as the potentials in the image forming mode (STEP 3). In other words, the main control section 101 controls the charging controls section 43 so that the photoconductor potential is set to −600 V, and also controls the development bias control section 44 so that the development bias potential is set to −400 V.

Under this condition, the developer discharge is executed (STEP 4). Specifically, the discharge port shutter 210 is pulled out, and the waste developer discharge from the developer discharge port 200*a* is started. As an alternative arrangement, the main control section 101 may display on the display means (not illustrated) that the condition is ready for developer discharge after the photoconductor potential and the development bias potential are set in STEP 3 at the same levels as to the potentials in image forming. Confirming the display, the user pulls out the discharge port shutter 210. As another alternative, driving means (not illustrated) for opening and closing the discharge port shutter 210 may be used. In this case, the main control section 101 controls the driving means to open (pull out) the discharge port shutter 210 after the process in STEP 3.

Subsequently, the main control section 101 refers to the timer 46 and determines whether the elapsed time, which is counted since the rotation of the development sleeve 31 and transport screws 33 and 34 started (rotation time of the actuating motor of the developer tank 35), exceeds a predetermined value (the predetermined time is referred to as n-seconds in this embodiment) (STEP 5). The "n" derives from the time point at which the amount of beads-carry-over starts increasing after the development unit 2 is actuated, as the amount of developer shifted onto the development sleeve 31 decreases, the amount of developer in the developer tank 35 decreases, and the congestion of the magnetic chains is reduced.

If it is determined in STEP 5 that the time n-seconds has not passed, the main control section 101 continues the developer discharge under the same condition.

On the other hand, if it is determined in STEP 5 that the time n-seconds has passed, the main control section 101 controls the charging control section 43 and the development bias control section 44 via the potential difference control section 41, so as to cause them to set a smaller potential difference between the photoconductor potential and the development bias potential such that the potential difference between the photoconductor potential and the development bias potential than that in the image forming mode (STEP 6). The time where the photoconductor potential and the development bias potential are started changing corresponds to the time T2 in FIG. 1(*b*), while the time where the changing is finished corresponds to the time T3 in FIG. 1(*b*). In FIG. 1(*b*), the potential difference between the photoconductor potential and the development bias potential is 0V at the time T3. However, the present invention is not limited to this arrangement. As long as the potential difference between the photoconductor potential and the development bias potential is set to a value smaller than that in the image forming mode, the beads-carry-over will be prevented.

Then, the main control section 101 refers to the timer 46 and determines whether the elapsed time, which is counted since the rotation of the development sleeve 31 and transport screws 33 and 34 started, exceeds a predetermined time (the predetermined time is referred to as m-seconds (m>n) in this example) (STEP 7). The time m-seconds is set, for example, to a value equal to a time period from the actuation of the development unit 2 to the completion of developer discharge from the developer tank 35.

If it is determined in STEP 7 that the time m-seconds has not passed, the main control section 101 continues the developer discharge under the same condition (condition where the potential difference between the photoconductor potential and the development bias potential is set small).

On the other hand, if it is determined in STEP 7 that the time m-seconds has passed, the main control section 101 controls the photoconductive drum drive control section 42 and the development unit drive control section 45, so as to cause them to stop rotating the photoconductive drum 3 and the development unit 2 (development sleeve 31, the transport screws 33 and 34) (STEP 8). Further, the main control section 101 controls the charging control section 43 and the development bias control section 44 via the potential difference control section 41 so that the photoconductor potential (photoconductor voltage) and the development bias potential (development bias voltage) is turned off (STEP 9). Consequently, the developer discharge mode, that is, the operation of the developer discharge control section is terminated.

As described above, in the image forming apparatus 100, the potential difference between the photoconductor potential and the development bias potential during developer discharge is set smaller than that in the image forming mode. This prevents increase of beads-carry-over, which is shifting of carrier onto the photoconductive drum, even when the amount of developer decreases as a consequence of developer discharge. Therefore, damage to the photoconductive drum 3 or image errors due to incomplete cleaning can be prevented.

With this structure, an image forming apparatus with a mechanism in which developer is discharged by the contact of the photoconductor and the development sleeve is given a function of preventing beads-carry-over during developer discharge. Thus, damage to the photoconductor or image error can be prevented without a complex mechanism or cost rise.

Further, in the image forming apparatus 100, the photoconductor potential and the development bias potential at the time developer discharge has just started (until the time n-seconds passes since the development unit 2 is actuated) are set so that their levels become equal to those in the image forming. This can prevent toner from adhering the photoconductive drum 3 (fog).

In the image forming apparatus 100, the potential difference between the photoconductor potential and the development bias potential is changed only once after the time n-seconds has passed since the development unit 2 is actuated. However, the present invention is not limited to this arrangement. In other words, the present invention is not limited to the embodiment described above, as long as the potential difference between the photoconductor potential and the development bias potential during developer discharge is set smaller than that in image forming, by which beads-carry-over during developer discharge is prevented.

For example, in the case where the decrease of beads-carry-over slowly happens along with the duration of the developer discharge, the potential difference between the photoconductor potential and the development bias potential may be decreased in stages. For example, the potential difference between the photoconductor potential and the development bias potential after the time n1-seconds has passed since the development unit 2 is actuated may be set to ΔV1 that is smaller than that in the image forming. Further, the potential difference after the time n2-seconds (n2>n1) has passed may be set to ΔV2 that is smaller than ΔV1.

Further, in the image forming apparatus 100, the timer 46 measures the elapsed time since the developer discharge mode is selected, and the photoconductor potential and the development bias potential are controlled according to this measured time. However, the present invention is not limited to this arrangement.

For example, the timer 46 may measure the elapsed time since the developer discharge is actually started. In this case, the photoconductor potential and the development bias potential are controlled according to this value.

This structure may use a sensor (open state detection means) for detecting opening action of the discharge port shutter 210 or the like, allowing the timer 46 to start counting time at the same time where the developer discharge is started in response to opening of the discharge port shutter 210. The sensor may be realized by an optical sensor including a light emitter and a photoreceptor may be used. In this case, for example the light emitter is disposed at a portion closest to the front face of the developer discharge port 200*a*, and the photoreceptor is disposed at an arbitrary portion on a top surface of the collecting container installation section 220 that is opposite to the developer discharge port 200*a*. The portions of the light emitter and the photoreceptor are interchangeable. Then, the photoreceptor receives light emitted from the light emitter while the discharge port shutter 210 completely opens the developer discharge port 200*a*, so that, for example, an output level is changed from "L" to "H", thereby detecting that the developer discharge port 200*a* is completely opened.

As described above, the elapsed time since the developer discharge is actually started is measured, and according to this measured time, the photoconductor potential and the development bias potential are controlled. This allows the photoconductor potential and the development bias potential to be appropriately controlled. This case also prefers the foregoing arrangement in which the photoconductor potential and the development bias potential are risen immediately before the developer discharge is started so that the photoconductor potential and the development bias potential immediately after the developer discharge is started are the same as those in the image forming.

Embodiment in which the Intermediate Transfer Belt is Separated

Further, the intermediate transfer belt (transfer means) 7 may be separated from the photoconductive drum 3 when the developer discharge mode is set (selected).

As described above, the intermediate transfer belt 7 can be separated from the photoconductive drum 3 by changing relative positions of the components in the intermediate transfer belt unit 8 by driving means (not illustrated), which components including the intermediate transfer rollers 6*a*-6*d*, the intermediate transfer belt driving roller 71, the intermediate transfer belt driven roller 72, and the intermediate transfer belt tension mechanism 73. Further, the intermediate transfer belt separation control section 47 controls the driving means, according to an instruction from the main control section 101, to separate the intermediate transfer belt 7 from the photoconductive drum 3.

The separation of intermediate transfer belt (transfer means) 7 from the photoconductive drum 3 at the start of the developer discharge mode may be performed in the following way. For example, as shown in the flow chart of FIG. 12, after the developer discharge mode is started in STEP 1 and before the photoconductor potential and the development bias potential are risen to the substantially same levels as those in the image forming, the main control section 101 controls the intermediate transfer belt separation control section 47 to separate the intermediate transfer belt 7 from the photoconductive drum 3.

As described above, when the developer discharge mode is executed, the intermediate transfer belt 7 is separated from the photoconductive drum 3 before the photoconductive drum 3 and the development unit 2 are actuated. This prevents damage, such as scratches on the photoconductive drum 3 and the intermediate transfer belt 7, that is caused by carriers adhered onto the intermediate transfer belt 7.

In other words, even when beads-carry-over occurs on the photoconductive drum 3, damage to the photoconductive drum 3 and the intermediate transfer belt 7 can be prevented, which damage is caused as a result that a carrier on the photoconductive drum 3 contacts with the intermediate transfer belt 7. Moreover, the damage to the intermediate transfer belt 7 that occurs when the carrier transferred from the photoconductive drum 3 to the intermediate transfer belt 7 is removed can be prevented.

In the foregoing example, separation of the intermediate transfer belt 7 from the photoconductive drum 3 is performed at the time of setting (selecting) the developer discharge mode, that is, before the developer discharge is actually started. However, the present invention is not limited to this arrangement. For example, the intermediate transfer belt 7 may be separated from the photoconductive drum 3 during developer discharge. It is, however, preferable that the photoconductor be separated from the intermediate transfer means before the developer discharge is started. With this arrangement, it is more assuredly prevent damage to the intermediate transfer means that is caused by the developer discharge.

Embodiment where the Photosensitive Drum and the Development Sleeve are Driven at a Same Speed Further, the photoconductive drum 3 and the development sleeve 31 may be rotated at a same speed (same peripheral speed) during the developer discharge. Specifically, the main control section 101 controls the photoconductive drum drive control section 42 and the development unit drive control section 45 to cause the photoconductive drum 3 and the development sleeve 31 to be driven at substantially the same peripheral speeds during the developer discharge.

Figure 13:
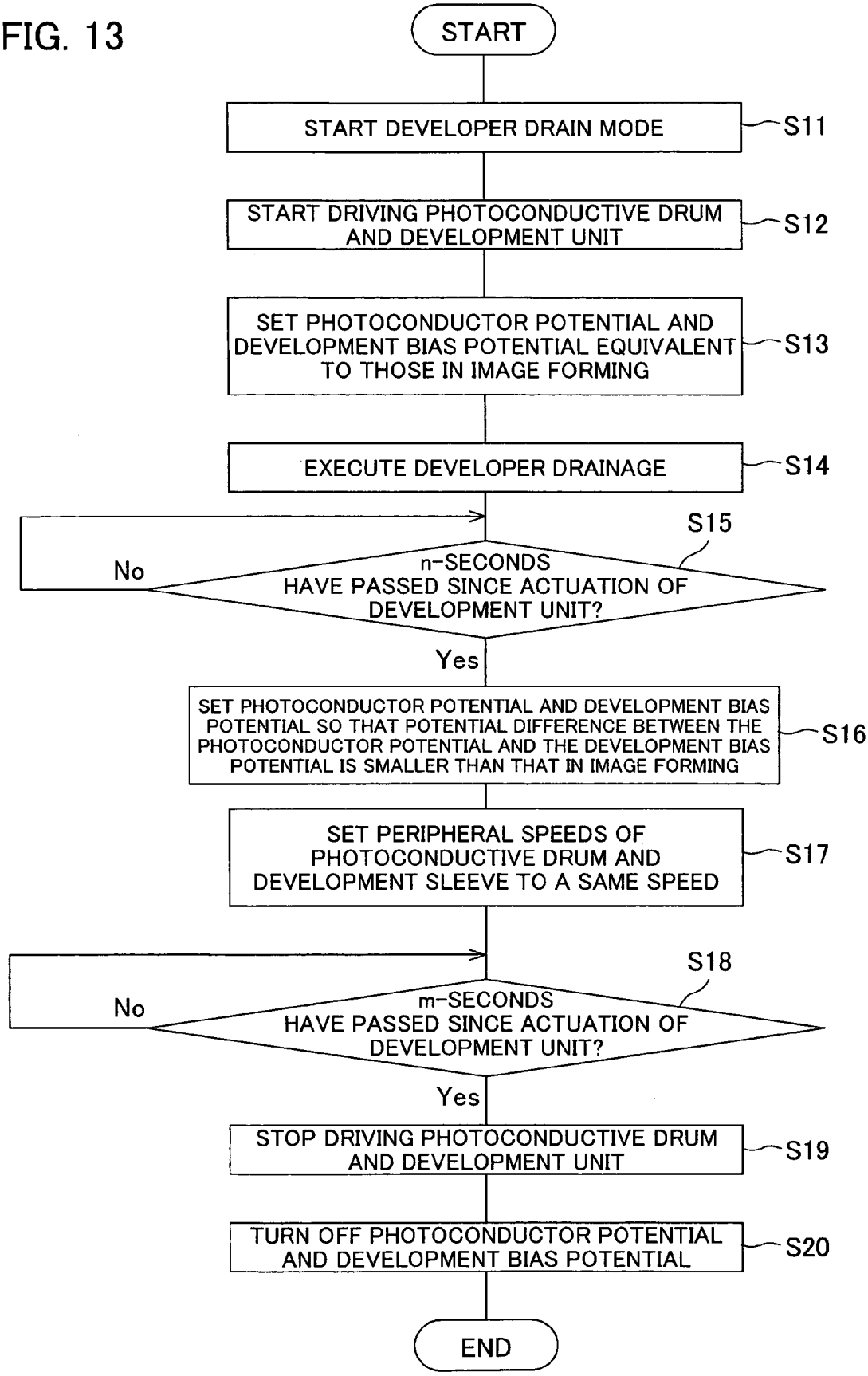
FIG. 13 is a flow chart showing another process sequence carried out by the developer discharge control section of FIG. 11.

The following describes a process carried out by the developer discharge control section 40 under the condition described above, with reference to FIG. 13. FIG. 13 is a flow chart illustrating exemplary operation (control method) of the developer discharge control section 40, provided that the photoconductive drum 3 and the development sleeve 31 are rotated at a same speed.

First, when the developer discharge mode is executed (selected) (STEP 11), the main control section 101 causes the photoconductive drum drive control section 42 and the development unit drive control section 45 to actuate and rotate the photoconductive drum 3 and the development unit 2 (development sleeve 31, transport screws 33 and 34), respectively (STEP 12). Here, for example, the rotation speeds of the photoconductive drum 3 and the development unit 2 (development sleeve 31, transport screws 33 and 34) may be set to the same speeds as those in the image forming (when an electrostatic latent image formed on the photoconductive drum 3 is developed). As described above, in the image forming apparatus 100, the peripheral speed of the development sleeve 31 in image forming is set 1.3 to 2.5 times faster than that of the photoconductive drum 3.

Further, the main control section 101 controls the charging control section 43 and the development bias control section 44 via the potential difference control section 41 to cause them to raise the photoconductor potential and the development bias potential to the same levels as those in the image forming (STEP 13). Specifically, the main control section 101 controls the charging control section 43 such that the photoconductor potential is set to −600 V, and controls the development bias control section 44 such that the development bias potential is set to −600 V.

Then, developer discharge is executed under the above condition (STEP 14). Specifically, the discharge port shutter 210 is pulled out, and waste developer discharge from the developer discharge port 200*a* is started.

Subsequently, the main control section 101 refers to the timer 46 and determines whether the elapsed time, which is counted since the rotation of the development sleeve 31 and transport screws 33 and 34 started (rotation time of the actuating motor of the developer tank 35), exceeds a predetermined value (the predetermined time is referred to as n-seconds in this embodiment) (STEP 5). The "n" derives from the time point at which the amount of beads-carry-over starts increasing after the development unit 2 is actuated, as the amount of developer shifted onto the development sleeve 31 decreases, the amount of developer in the developer tank 35 decreases, and the congestion of the magnetic chains is reduced.

If it is determined in STEP 15 that the time n-seconds has not passed, the main control section 101 continues the developer discharge under the same condition.

On the other hand, if it is determined in STEP 15 that the time n-seconds has passed, the main control section 101 causes the charging control section 43 and the development bias control section 44 via the potential difference control section 41 to change (set) the photoconductor potential and the development bias potential, such that the potential difference between the photoconductor potential and the development bias potential becomes smaller than that in the image forming mode (STEP 16).

Subsequently, the main control section 101 controls the photoconductive drum drive control section 42 and the development unit drive control section 45, so as to cause them to set the rotation speeds (peripheral speeds) of the photoconductive drum 3 and the development sleeve 31 to the same speed (STEP 17). Here, the rotation speed of the development sleeve 31 is lowered whereas that of the photoconductive drum 3 is maintained, so that their rotation speeds are equalized.

Then, the main control section 101 refers to the timer 46 and determines whether the elapsed time, which is counted since the rotation of the development sleeve 31 and transport screws 33 and 34 started, exceeds a predetermined time (the predetermined time is referred to as m-seconds (m>n)) (STEP 18). The time m-seconds is set, for example, to a value equal to a time period from the actuation of the development unit 2 to the completion of developer discharge from the developer tank 35.

If it is determined in STEP 18 that the time m-seconds has not passed, the main control section 101 continues the developer discharge under the same condition (condition where the potential difference between the photoconductor potential and the development bias potential is set small).

On the other hand, if it is determined in STEP 18 that the time m-seconds has passed, the main control section 101 controls the photoconductive drum drive control section 42 and the development unit drive control section 45 so that the photoconductive drum 3 and the development unit 2 (development sleeve 31, transport screws 33 and 34) are stopped (STEP 19). Further, the main control section 101 controls the charging control section 43 and the development bias control section 44 via the potential difference control section 41, such that the photoconductor potential (photoconductor voltage) and the development bias potential (development bias voltage) are turned off (STEP 20). Consequently, the developer discharge mode, that is, the operation of the developer discharge control section is terminated.

As described above, the peripheral speeds of the development sleeve 31 and the photoconductive drum 3 are set to the same speed. This reduces the frequency of contacts between the photoconductive drum 3 and the magnetic chains of the developer on the development sleeve 31. Further, reduction in rotation speed of the development sleeve 31 reduces probability of occurrence of beads-carry-over. The beads-carry-over is thus prevented.

In the above description, the rotation speed of the photoconductive drum 3 is maintained whereas that of the development sleeve 31 is lowered, so as to equalize their rotation speeds. However, the present invention is not limited to this arrangement. For example, both of the rotation speeds of the photoconductive drum 3 and the development sleeve 31 may be changed, or only the rotation speed of the photoconductive drum 3 may be changed.

It is, however, preferable that the rotation speed of the photoconductive drum 3 or the development sleeve 31 be set slower than that in the image forming so that the frequency of contacts between the photoconductive drum 3 and the magnetic chains of the developer on the development sleeve 31 is reduced. This reduces probability of occurrence of beads-carry-over. The beads-carry-over is thus prevented.

Further, it is preferable that the rotation speed of the development sleeve 31 be slower than that in image forming. In this case, the peripheral speed of the development sleeve 31 is lowered, and physical disconnection of carriers is reduced. Therefore, beads-carry-over can be suitably prevented.

Further, among the development sleeve 31 and the transport screw 33 and 34, all of which are included in the development unit 2, only the rotation speed of the development sleeve 31 may be changed. Another option is to change both of the rotation speeds of the development sleeve 31 and the transport screws 33 and 34. In this case, the actuation mechanism can be more simplified, compared to the case where the transport screw 33 and 34 and the development sleeve 31 are independently driven.

Embodiment where Control is Carried Out according to the Detection Result of the Developer Density Sensor Further, in the control methods described above, the photoconductor potential and the development bias potential are controlled according to the elapsed time, which is counted by the timer 46 since rotation of the development unit 2 is started. However, the present invention is not limited to this arrangement. For example, the developer density sensor (detection means) 38 may detect the density of developer in the developer tank 35 or the amount of residual developer (liquid surface level of the developer) during the developer discharge, and the photoconductor potential and the development bias potential may be controlled according to this detection result.

Figure 14:
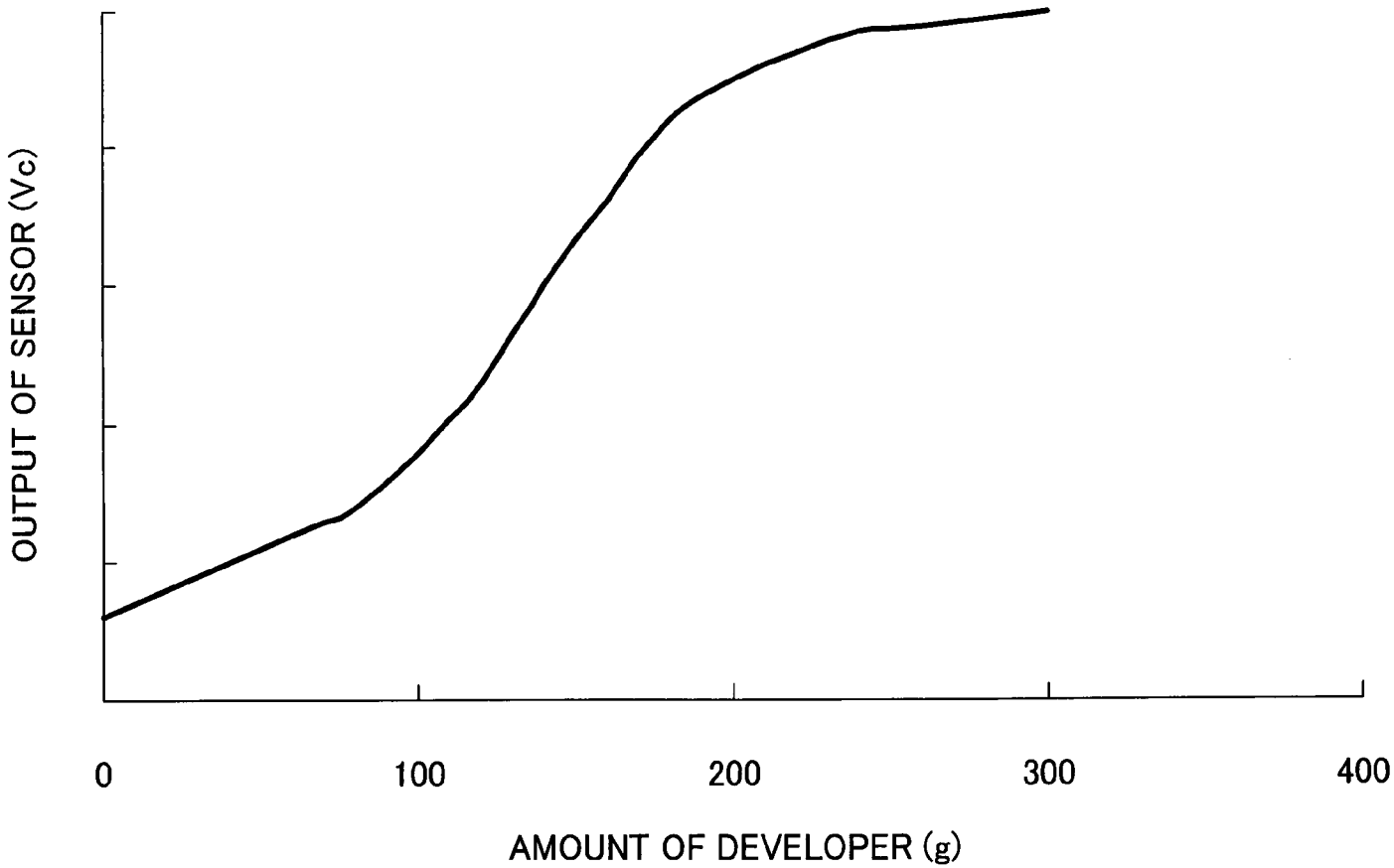
FIG. 14 is a graph showing a relationship between (i) an amount of developer in the developer tank of the development unit of FIG. 4 and (ii) a detection output by a developer density sensor.

FIG. 14 is a graph showing a relationship between amounts of developer in the developer tank 35 and detection outputs (sensor output Vc) of the developer density sensor 38. As shown in the figure, the detection outputs from the developer density sensor 38 notifies the main control section 101 of information regarding the amount of developer in the developer tank 35. Disposed on a side face in the developer tank 35 as described above, the developer density sensor 38 can accurately measure changes of the liquid surface level (height of the liquid surface) of the developer in the developer tank 35.

As described above, the amount of developer in the developer tank 35 decreases as the developer is discharged, and in a case where the developer density sensor 38 is disposed on the bottom face of the developer tank, developer remains in the vicinity of the developer density sensor 38 until the developer in the developer tank 35 is almost completely discharged. Therefore, in order to detect whether the amount of developer on the development sleeve 31 decreases as the amount of developer in the developer tank 35 decreases, it is preferable that the developer density sensor 38 be disposed on a lateral side face, rather than on the bottom face, of the developer tank 35. This enables the changes on the surface of the developer in the developer tank 35 to be more accurately detected. Specifically, it is preferable that the developer density sensor 38 be disposed at the same height as that of the transport pole N2 of the development sleeve 31 described above.

Figure 15:
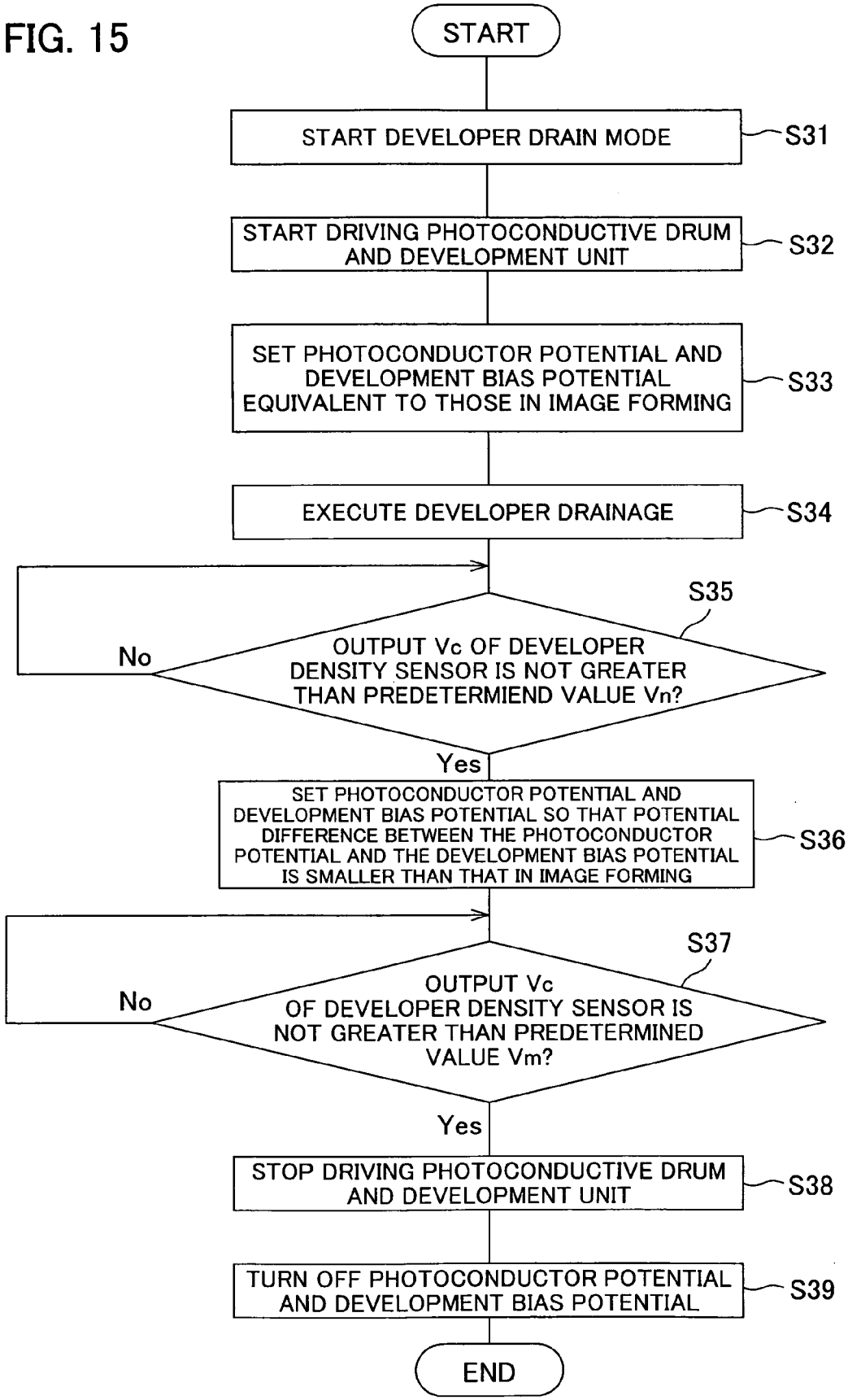
FIG. 15 is a flow chart showing another process sequence carried out by the developer discharge control section of FIG. 11.

The following describes exemplary operation (control method) of the developer discharge control section 40 in a case where the photoconductor potential and the development bias potential are controlled according to a detection result by the developer density sensor 38 during the developer discharge mode, with reference to the flow chart illustrated in FIG. 15.

First, when the developer discharge mode is selected (STEP 31), the main control section 101 causes the photoconductive drum drive control section 42 and the development unit drive control section 45 to rotate the photoconductive drum 3 and the development unit 2 (development sleeve 31, transport screws 33 and 34), respectively (STEP 32). Here, for example, the rotation speeds of the photoconductive drum 3 and the development unit 2 (development sleeve 31, transport screws 33 and 34) may be set at the same speeds as those in the image forming.

Further, the main control section 101 controls the charging control section 43 and the development bias control section 44 via the potential difference control section 41 such that the photoconductor potential and the development bias potential are risen to the same potentials as those in the image forming (STEP 33). Specifically, the main control section 101 controls the charging control section 43 such that the photoconductor potential is set to −600 V, and controls the development bias control section 44 such that the development bias potential is set to −400 V.

Then, the developer discharge is executed in the above condition (STEP 34). Specifically, the discharge port shutter 210 is pulled out, and waste developer discharge from the developer discharge port 200*a* is started.

Subsequently, the main control section 101 determines whether the output Vc of the developer density sensor is not more than a predetermined value Vn (STEP 5). The predetermined value Vn is supposed to be equal to the output value of the developer density sensor 38 at the time where the amount of beads-carry-over starts increasing after the amount of developer in the developer tank 35 decreases, the amount of developer shifted onto the development sleeve 31 decreases, and the congestion of the magnetic chains becomes lower. In other words, the predetermined value Vn is supposed to be equal to output value by which the permeability becomes appropriate for the amount of developer (carrier) in the developer tank 35 when beads-carry-over starts decreasing as a result that the amount of developer decreases due to developer discharge.

Then, if it is determined in STEP 35 that the output Vc of the developer density sensor 38 is greater than the predetermined value Vn (Vc>Vn), the main control section 101 continues developer discharge under the same condition.

On the other hand, if it is determined in STEP 35 that the output Vc of the developer density sensor 38 is equal to or lower than the predetermined value Vn (Vc≦Vn), the main control section 101 causes the charging control section 43 and the development bias control section 44 via the charging control section 43 to change the photoconductor potential and the development bias potential such that the potential difference between the photoconductor potential and the development bias potential is set to a value smaller than that in the image forming mode (STEP 36).

Subsequently, the main control section 101 determines whether the output Vc of the developer density sensor 38 is equal to or lower than the predetermined value Vm (STEP 37). The predetermined value Vm is set at an output value of the developer density sensor 38 when the developer in the developer tank 35 is completely discharged and the density of the developer in the vicinity of the developer density sensor 38 becomes insufficient.

If it is determined in STEP 37 that the output Vc of the developer density sensor 38 is greater than the predetermined value Vm (Vc>Vm), the main control section 101 continues developer discharge under the same condition (condition where the potential difference between the photoconductor potential and the development bias potential is set small).

On the other hand, if it is determined in STEP 37 that the output Vc of the developer density sensor 38 is equal to or lower than the predetermined value Vm (Vc≦Vm), the main control section 101 causes the photoconductive drum drive control section 42 and the development unit drive control section 24 to stop rotation of the photoconductive drum 3 and the development unit 2 (development sleeve 31, transport screws 33 and 34) (STEP 38). Further, the main control section 101 controls the charging control section 43 and the development bias control section 44 via the potential difference control section 41 so that the photoconductor potential (photoconductor voltage) and the development bias potential (development bias voltage) is turned off (STEP 39). Consequently, the developer discharge mode, that is, the operation of the developer discharge control section 40 is terminated.

As described above, when the developer discharge mode is selected, the potential difference between the photoconductor potential and the development bias potential is controlled according to a density detection result of the developer density sensor 38. In other words, the potential difference between the photoconductor potential and the development bias potential is controlled according to an accurately detected amount of developer in the developer tank 35. Therefore, the potential difference between the photoconductor potential and the development bias potential can be controlled at an appropriate timing (the potential difference can be set smaller than that in image forming). This assuredly prevents increase of beads-carry-over on the photoconductive drum 3 even when the amount of developer in the developer tank 35 decreases due to developer discharge. Therefore, damage, such as scratches on the photoconductive drum 3, or image forming errors due to incomplete cleaning or other factors can be assuredly prevented.

If the developer density sensor 38 is disposed on a lateral face of the developer tank in order to accurately monitor the amount of developer during the developer discharge, there may be a case where no developer exists in the vicinity of the developer density sensor 38 although some developer remains in the developer tank 35. Thus, for example, after it is detected in STEP 37 that the output Vc of the developer density sensor 38 is equal to or lower than the predetermined value Vm, the developer discharge may be continued for a certain period of time before STEP 38 and the subsequent steps are carried out.

Further, the developer density sensor 38 may be so designed as to detect (i) the density of the developer at the height of the transport pole N2 of the development sleeve 31, and (ii) the density of the developer near the bottom face of the developer tank 35. Alternately, two separate developer density sensors may be used as the developer density sensor 38, respectively for measuring the density of the developer at the same height as the transport pole N2 of the development sleeve 31, and for detecting the density of the developer near the bottom face of the developer tank 35. In this case, the former developer density sensor 38 is used for the determination in STEP 36, while the latter developer density sensor 38 is used for the determination in STEP 38.

Further, in place of the developer density sensor 38, a developer liquid surface sensor (detection means), which is not illustrated in the figures, may be adopted. The developer liquid surface sensor does not detect the density of the developer but only detects a change of the liquid surface level of the developer (height of the liquid surface) in the developer tank 35. The photoconductor potential and the development bias potential may be controlled according to a result of the detection.

Embodiment where Rotation of Photosensitive Drum is Stopped during Developer Drainage Still further option may be a structure in which the photoconductive drum 3 and the development sleeve 31 are rotated at the same speed until a certain time passes since execution of the developer discharge mode is started, and only the rotation of development sleeve 31 continues after the time has passed.

Figure 16:
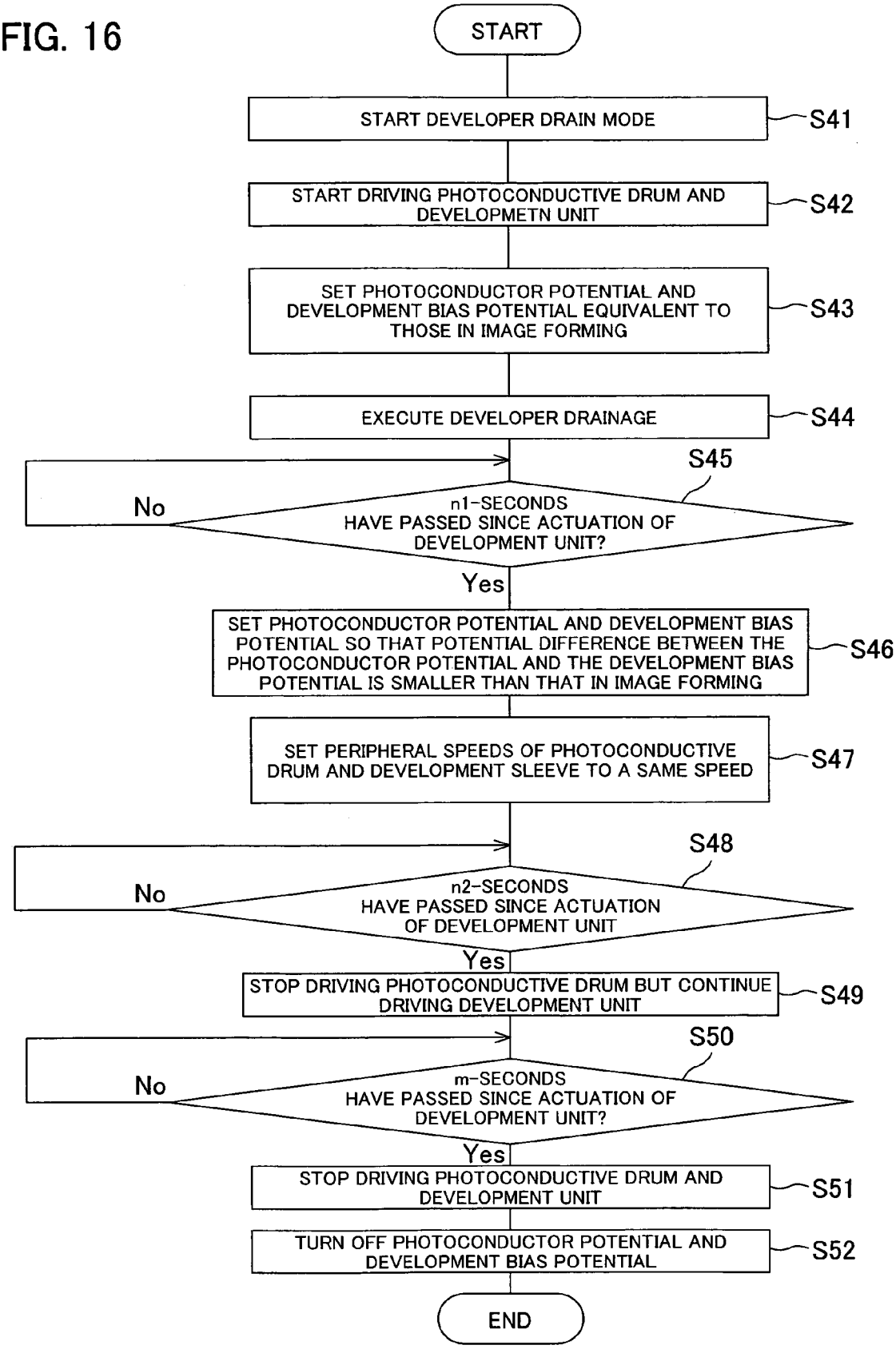
FIG. 16 is a flow chart showing another process sequence carried out by the developer discharge control section of FIG. 11.

The following describes exemplary operation (control method) of the developer discharge mode in the above case, with reference to the flow chart illustrated in FIG. 16. FIG. 16 is a flow chart illustrating exemplary operation of the developer discharge control section 40 in a case where the photoconductive drum 3 and the development sleeve 31 are rotated at the same speed until a certain time has passed since execution of the developer discharge mode was started, and only the rotation of development sleeve 31 continues after the time has passed.

When the developer discharge mode is selected (STEP 41), the main control section 101 causes the photoconductive drum drive control section 42 and the development unit drive control section 45 to start rotation of the photoconductive drum 3 and the development unit 2 (development sleeve 31, transport screws 33 and 34) (STEP 42). Here, the photoconductive drum 3 and the development unit 2 (development sleeve 31, transport screws 33 and 34) may be rotated at the same speeds as those in the image forming.

Further, the main control section 101 controls the charging control section 43 and the development bias control section 44 via the potential difference control section 41 such that the photoconductor potential and the development bias potential are risen to the same levels as those in the image forming (STEP 43). Specifically, the main control section 101 controls the charging control section 43 such that the photoconductor potential is set to −600 V, and controls the development bias control section 44 such that the development bias potential is set to −400 V.

Then, the developer discharge is executed under the above condition (STEP 44). Specifically, the discharge port shutter 210 is pulled out, and the discharge of the waste developer from the developer discharge port 200*a* is started.

Subsequently, the main control section 101 refers to the timer 46 and determines whether the elapsed time, which is counted since the rotation of the development sleeve 31 and transport screws 33 and 34 started (rotation time of the actuating motor of the developer tank 35), exceeds a predetermined value (the predetermined time is referred to as n-seconds in this embodiment) (STEP 5). The "n" derives from the time point at which the amount of beads-carry-over starts increasing after the development unit 2 is actuated, as the amount of developer shifted onto the development sleeve 31 decreases, the amount of developer in the developer tank 35 decreases, and the congestion of the magnetic chains is reduced.

If it is determined in STEP 45 that the time n1-seconds has not passed, the main control section 101 continues the developer discharge under the same condition.

On the other hand, if it is determined in STEP 45 that the time n1-seconds has passed, the main control section 101 causes the charging control section 43 and the development bias control section 44 via the charging control section 43 to change the photoconductor potential and the development bias potential, such that the potential difference between the photoconductor potential and the development bias potential is smaller than that in the image forming mode (STEP 46).

Subsequently, the main control section 101 causes the photoconductive drum drive control section 42 and the development unit drive control section 45 to change the peripheral speed of the development sleeve 31, while maintaining the peripheral speed (rotation number) of the photoconductive drum 3, until the peripheral speed becomes equal to that of the photoconductive drum 3 (STEP 47).

Then, the main control section 101 refers to the timer 46 and determines whether the elapsed time, which is counted since the rotation of the development sleeve 31 and transport screws 33 and 34 started, exceeds a predetermined value (the predetermined time is referred to as n2-seconds (n2>n1) in this embodiment) (STEP 48). The time "n2-seconds" derives from the time point at which the amount of developer in the developer tank 35 decreases to a certain point after the development unit 2 is actuated, and the amount of beads-carry-over onto the photoconductive drum 3 becomes very few because the developer shifted onto the development sleeve 31 is significantly reduced.

If it is determined in STEP 48 that the time n2-seconds has not passed, the main control section 101 continues the developer discharge under the same condition (condition where the potential difference between the photoconductor and the development bias potential is set small).

On the other hand, if it is determined in STEP 48 that the time n2-seconds has passed, the main control section 101 causes the photoconductive drum drive control section 42 and the development unit drive control section 45 to stop the rotation of the photoconductive drum 3 while maintaining the rotation of the development unit 2 (development sleeve 31, transport screws 33 and 34) (STEP 49).

Then, the main control section 101 refers to the timer 46 and determines whether the elapsed time, which is counted since the rotation of the development sleeve 31 and transport screws 33 and 34 started, exceeds a predetermined time (the predetermined time is referred to as m-seconds (m>n2>n1)) (STEP 50). The time m-seconds is set, for example, to a value equal to a time period from the actuation of the development unit 2 to the completion of developer discharge from the developer tank 35.

If it is determined in STEP 50 that the time m-seconds has not passed, the main control section 101 continues the developer discharge under the same condition (condition where the rotation of the photoconductive drum 3 is stopped while the rotation of the development unit 2 is continued).

On the other hand, if it is determined in STEP 50 that the time m-seconds has passed, the main control section 101 controls the developer unit drive control section 45 so that the development unit 2 (development sleeve 31, transport screws 33 and 34) is stopped (STEP 51). Further, the main control section 101 controls the charging control section 43 and the development bias control section 44 via the potential difference control section 41, such that the photoconductor potential (photoconductor voltage) and the development bias potential (development bias voltage) are turned off (STEP 52). Consequently, the developer discharge mode, that is, the operation of the developer discharge control section is terminated.

After the amount of developer in the developer tank 35 decreases to a certain point, and the amount of beads-carry-over onto the photoconductive drum 3 becomes very few because the developer transported onto the development sleeve 31 is significantly reduced (after the predetermined time n2-seconds has passed), the rotation of the photoconductive drum 3 is stopped, and only the development unit 2 is driven. With this arrangement, the rotation of the photoconductive drum 3 is stopped before the carrier thereon on is brought into contact with the cleaning blade 4B, and therefore prevents damage, such as scratches on the cleaning blade 4B or the photoconductive drum 3, that is caused by transfer of carrier from the photoconductive drum 3 onto the cleaning blade 4B.

In this case, after the time period (predetermined time n1), which is counted from since the development unit 2 is actuated, elapsed, the amount of developer shifted onto the development sleeve 31 decreases as the amount of developer in the developer tank 35 decreases, the congestion of the magnetic chains is reduced, and consequently the amount of beads-carry-over starts increasing, the potential difference between the photoconductor potential and the development bias potential during developer discharge is set smaller than that in image forming. This prevents increase of beads-carry-over onto the photoconductive drum even when the amount of developer decreases as a consequence of developer discharge. Therefore, damage to the photoconductive drum 3 or image errors due to incomplete cleaning can be prevented.

In the flow chart of FIG. 16, driving of the photoconductive drum 3 and the development unit 2, the photoconductor potential, and the development bias potential are controlled according to the elapsed time, which is counted by the timer 46 since the developer unit 2 is actuated. However, the present invention is not limited to this arrangement.

For example, in the same manner as FIG. 14, the driving of the photoconductive drum 3 and the development unit 2, the photoconductor potential, and the development bias potential may be controlled according to the detection result by the developer density sensor 38. Specifically, when the density of developer or the liquid surface level of the developer that is detected by the developer density sensor 38 reaches a predetermined value (second predetermined value) after the developer discharge from the developer tank 35 is started, the main control section 101 may control the photoconductive drum drive control section 42 and the development unit drive control section 45, such that the peripheral speeds of the photoconductive drum 3 and the development sleeve 31 become the same and one of or both of the peripheral speeds thereof become slower than that during development of an electrostatic latent image formed on the photoconductive drum 3. Further, the main control section 101 may stop rotation of the photoconductive drum 3 when the density of developer or the liquid surface level of the developer, that is detected by the developer density sensor 38, reaches a predetermined value (third predetermined value).

In this case, the driving of the photoconductive drum 3 and the development unit 2, the photoconductor potential, and the development bias potential are controlled according to the accurately detected amount of the developer in the developer tank 35. With this arrangement, the respective controls can be carried out at appropriate timings with high accuracy.

Embodiment where the Present Invention is Applied to an Image Forming Apparatus Adopting AC Superposition Development Method Further, the present invention is applicable to an image forming apparatus adopting AC superposition development method. In the AC superposition development method, an alternating voltage (AC) is superposed on a development bias voltage that is to be applied to the development sleeve 31.

A two-component development using small granular toner adopts a method in which an alternating current component is superposed on a development bias for the purpose of improving development efficiency and increasing toner adhesion amount. However, the superposition of alternating current component may result in increase in number of carriers adhering to the photoconductive drum 3 (beads-carry-over) during the developer discharge due to reciprocation of the electric field by the alternating current component.

On the other hand, in the developer discharge mode, it is not necessary to improve efficiency or uniformity with regard to the amount of adhering toner onto the photoconductive drum 3. Therefore, it is preferable to use a development bias voltage containing only a direct current component, in other words, a development bias voltage not containing an alternating current component. The following describes one instantial case of applying the present invention to image forming apparatus adopting the AC superposition development method. In the case below, the developer discharge control section 40 removes an alternating current component from the development bias voltage during the developer discharge so that the development bias voltage contains only a direct current component.

Figure 17:
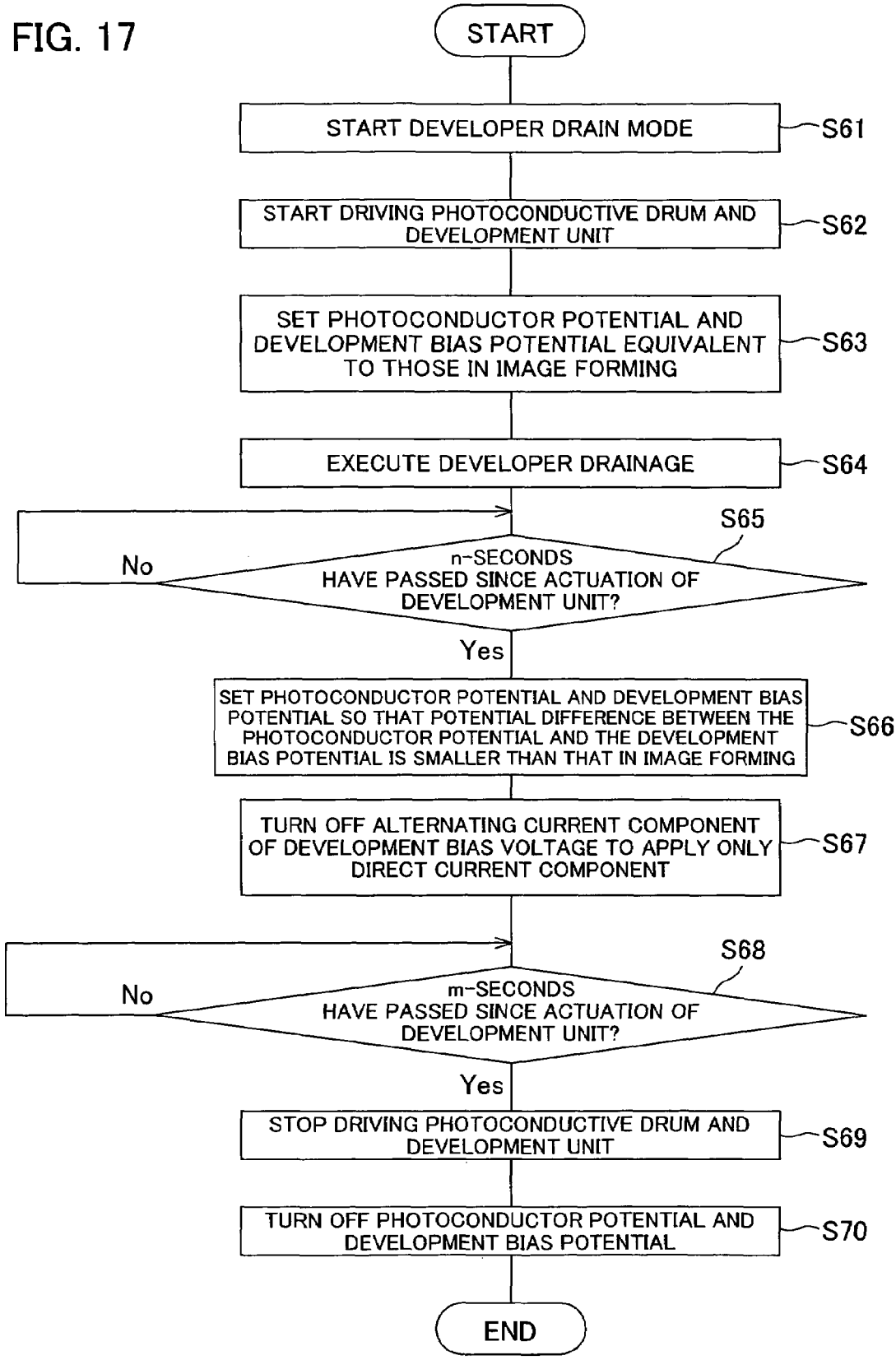
FIG. 17 is a flow chart showing a process sequence according to the developer discharge mode carried out by the developer discharge control section of FIG. 11 in an image forming apparatus adopting the AC superposition development method.

FIG. 17 is a flow chart illustrating exemplary operation (control method) of the developer discharge control section 40 in the case where the developer discharge mode is executed in the image forming apparatus 100 adopting the AC superposition development method.

When the developer discharge mode is selected (STEP 61), the main control section 101 causes the photoconductive drum drive control section 42 and the development unit drive control section 45 to rotate the photoconductive drum 3 and the development unit 2 (development sleeve 31, transport screws 33 and 34) (STEP 62). Here, for example, the rotation speeds of the photoconductive drum 3 and the development unit 2 (development sleeve 31, transport screws 33 and 34) may be set to the same speeds as those in the image forming.

Further, the main control section 101 controls the charging control section 43 and the development bias control section 44 via the potential difference control section 41 so that the photoconductor potential and the development bias potential are risen to the same levels as those in the image forming (STEP 63). Specifically, the main control section 101 controls the charging control section 43 such that the photoconductor potential is set to −600 V, and controls the development bias control section 44 such that the development bias potential is set to −400 V.

Then, the developer discharge is executed while maintaining the above condition (STEP 64). In other words, the discharge port shutter 210 is pulled out, and the waste developer discharge from the developer discharge port 200*a* is started.

Subsequently, the main control section 101 refers to the timer 46 and determines whether the elapsed time, which is counted since the rotation of the development sleeve 31 and transport screws 33 and 34 started (rotation time of the actuating motor of the developer tank 35), exceeds a predetermined value (the predetermined time is referred to as n-seconds in this embodiment) (STEP 65). The "n" derives from the time point at which the amount of beads-carry-over starts increasing after the development unit 2 is actuated, as the amount of developer shifted onto the development sleeve 31 decreases, the amount of developer in the developer tank 35 decreases, and the congestion of the magnetic chains is reduced.

If it is determined in STEP 65 that the time n-seconds has not passed, the main control section 101 continues the developer discharge under the same condition.

On the other hand, if it is determined in STEP 65 that the time n-seconds has passed, the main control section 101 causes the charging control section 43 and the development bias control section 44 via the potential difference control section 41 to change (set) the photoconductor potential and the development bias potential, such that the potential difference between the photoconductor potential and the development bias potential becomes smaller than that in the image forming mode (STEP 66).

Further, the main control section 101 causes the development bias control section 44 via the potential difference control section 41 to remove the alternating current component (AC component) from the development bias voltage and to change only the direct current component (DC component) (STEP 67).

Then, the main control section 101 refers to the timer 46 and determines whether the elapsed time, which is counted since the rotation of the development sleeve 31 and transport screws 33 and 34 started, exceeds a predetermined time (the predetermined time is referred to as m-seconds (m>n)) (STEP 68). The time m-seconds is set, for example, to a value equal to a time period from the actuation of the development unit 2 to the completion of developer discharge from the developer tank 35.

If it is determined in STEP 68 that the time m-seconds has not passed, the main control section 101 continues the developer discharge under the same condition (condition where the potential difference between the photoconductor potential and the development bias potential is set small).

On the other hand, if it is determined in STEP 68 that the time m-seconds has passed, the main control section 101 causes the photoconductive drum drive control section 42 and the development unit drive control section 45 to stop the photoconductive drum 3 and the development unit 2 (development sleeve 31, transport screws 33 and 34) (STEP 69). Further, the main control section 101 controls the charging control section 43 and the development bias control section 44 via the potential difference control section 41 so that the photoconductor potential (photoconductor voltage) and the development bias potential (development bias voltage) are turned off (STEP 70). Consequently, the developer discharge mode, that is, the operation of the developer discharge control section 40 is terminated.

As described above, the alternating current component of the development bias voltage that is to be applied to the development sleeve 31 is turned off during the developer discharge. This prevents increase of carrier adhesion onto the photoconductive drum 3 (beads-carry-over) caused by reciprocation of the electric field induced by the alternating current component. Therefore, increase of beads-carry-over on the photoconductive drum 3 can be prevented despite the decrease in amount of developer in the developer tank 35 decreases due to the developer discharge. This prevents damage, such as scratches on the photoconductive drum, or image forming errors due to, for example, incomplete cleaning.

Further, in the image forming apparatus 100, the potential difference between the photoconductor potential and the development bias potential during developer discharge is set smaller than that in image forming. This prevents increase of beads-carry-over onto the photoconductive drum even when the amount of developer decreases as a consequence of developer discharge. Therefore, damage to the photoconductive drum 3 or image errors due to, for example, incomplete cleaning can be prevented.

Further, when the developer discharge mode is selected, the intermediate transfer belt 7 is detached from the photoconductive drum 3 before the photoconductive drum 3 and the development unit 2 are driven. This prevents damage, such as scratches on the intermediate transfer belt 7, caused by the carriers on the intermediate transfer belt 7.

In FIG. 17, AC superposition is stopped (the alternating current component is removed from the development bias voltage) at a timing corresponding to the time-n that is when the amount of beads-carry-over starts increasing after the development unit 2 is actuated, as the congestion of the magnetic chains becomes lower due to a decrease in amount of developer shifted onto the development sleeve 31 with a decrease in amount of developer in the developer tank 35. However, the present invention is not limited to this arrangement. For example, the AC superposition may be stopped at a predetermined timing, after the developer discharge mode is started (after the development unit 2 is actuated), before the toner is scattered in the apparatus (image forming apparatus 100) because of the toner-carry-over on the photoconductive drum 3. Further, the AC superposition may be stopped at an appropriate timing depending on the detection result of the developer density sensor 38.

Embodiment in which Operation History is Erased when the Developer Discharge is Finished Further, the operation history stored in the operation history storing section 48 may be erased at the end of the developer discharge. The operation history storing section 48 is memory means for storing operation history (operation history information) such as a number of papers on which developer is transferred (an accumulated number of recording papers on which images have been formed since the previous replacement of the developer). In other words, the operation history that has been stored in the operation history storing section 48 since the previous developer discharge (replacement of developer) until the current developer discharge may be erased when the current developer discharge is finished.

Figure 18:
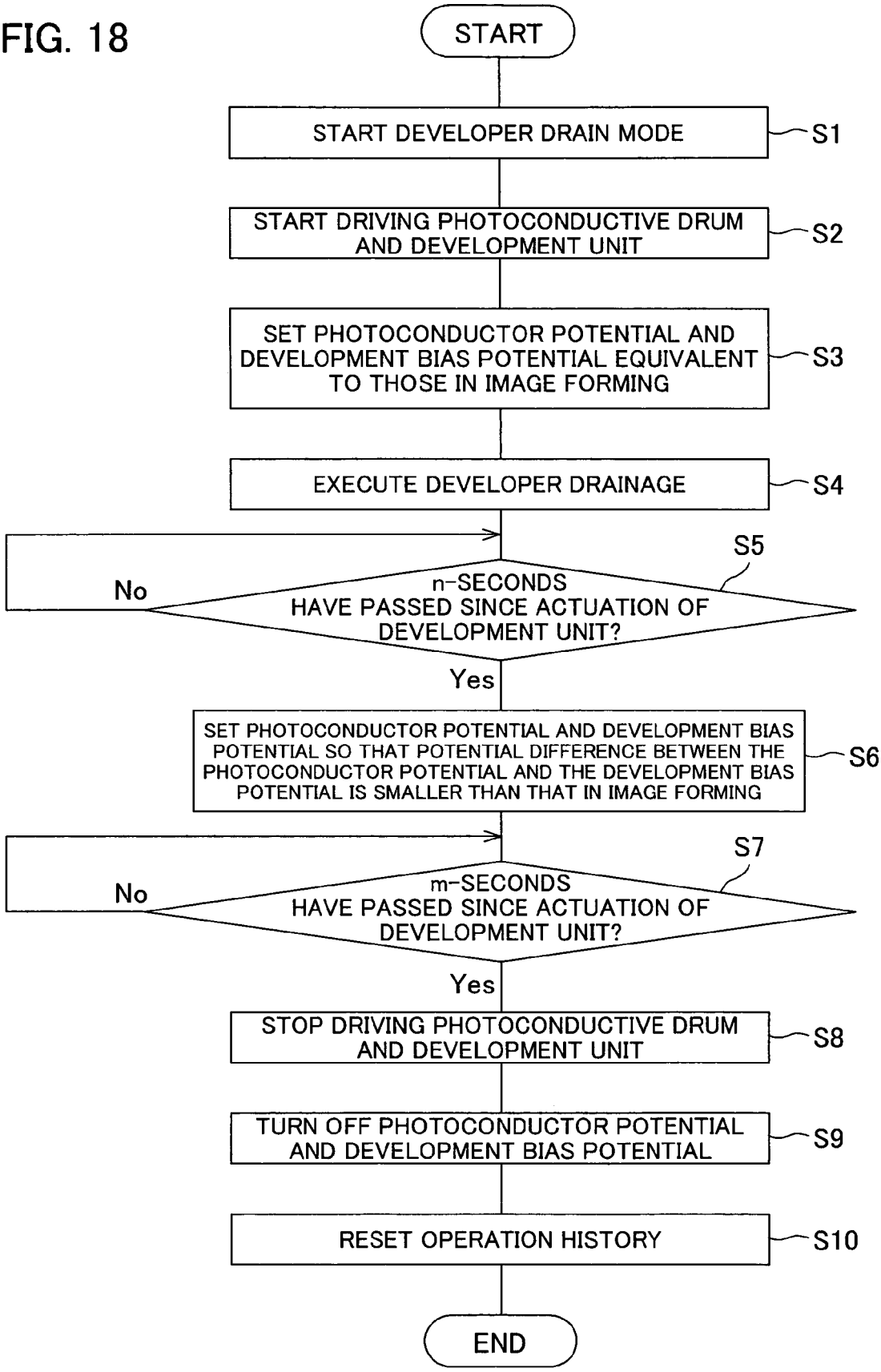
FIG. 18 is a flow chart showing another process sequence carried out by the developer discharge control section of FIG. 11.
Figure 19:
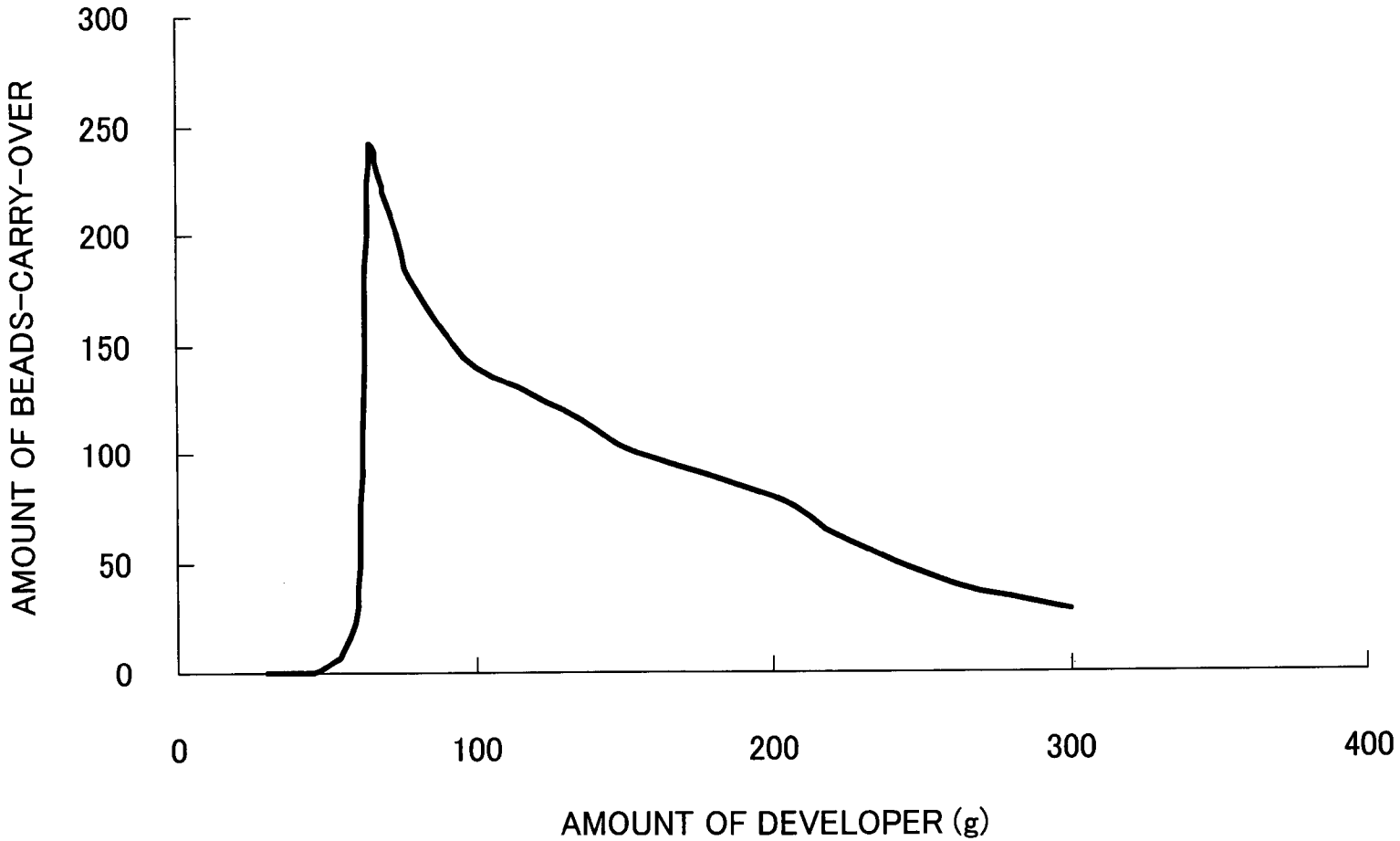
FIG. 19 is a graph showing a relationship, during developer discharge from the developer tank, between (i) an amount of residual developer in the developer tank and (ii) an amount of the beads-carry-over to a photoconductor, according to a conventional image forming apparatus.
Figure 20:
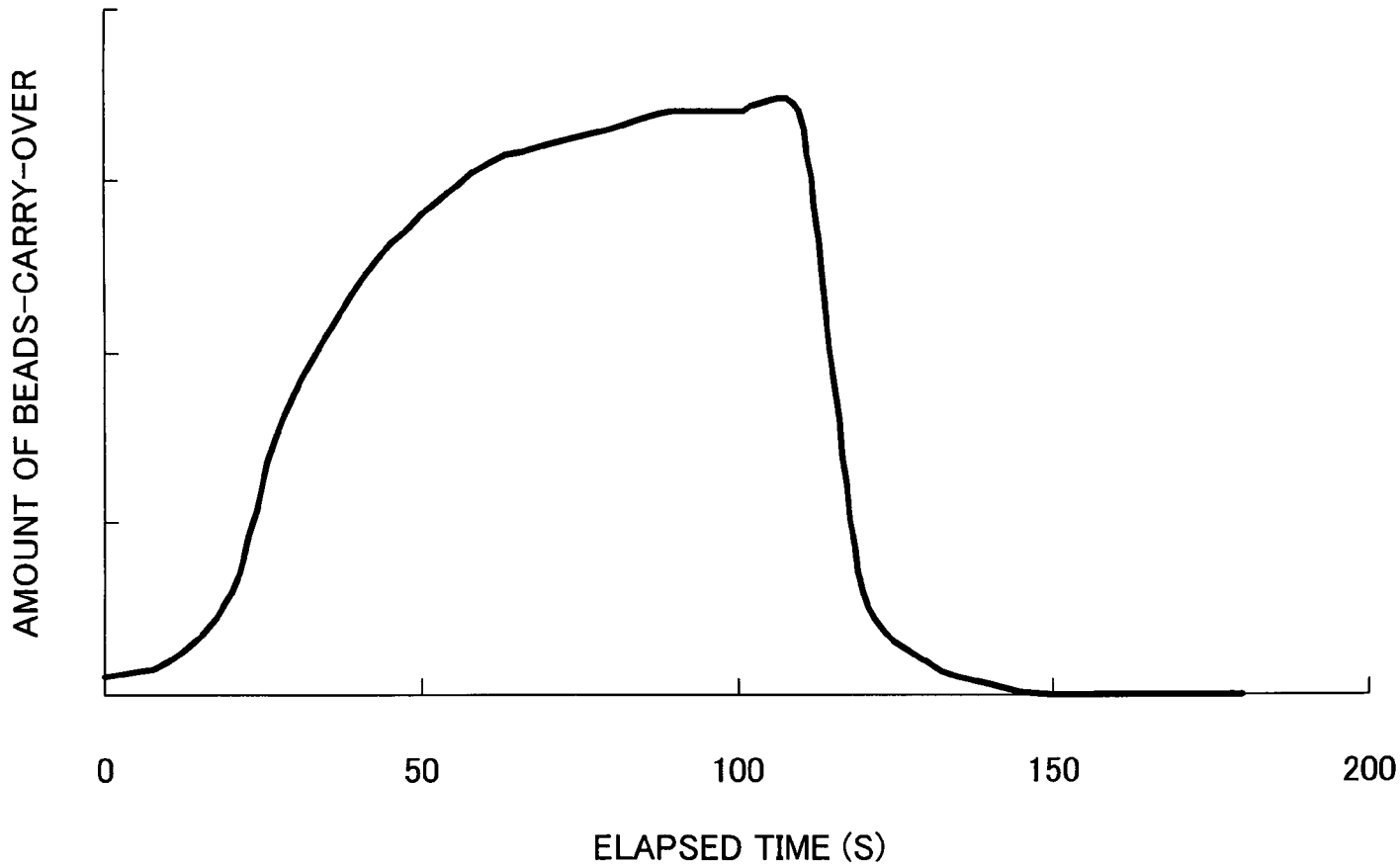
FIG. 20 is a graph showing a relationship, during developer discharge from the developer tank, between (i) an elapsed time from when the developer discharge is started and (ii) the amount of the beads-carry-over to the photoconductor, according to a conventional image forming apparatus.

The following describes a process (control method) carried out in the developer discharge control section 40, with reference to the flow chart illustrated in FIG. 18.

When the developer discharge mode is selected, the main control section 101 carries out the same processes as STEP 1 to STEP 9 in FIG. 12. When the process of STEP 9 is finished, the main control section 101 erases the operation history stored in the operation history storing section 48 (STEP 10).

As described above, when the developer discharge is finished, the main control section 101 automatically erases the operation history, such as the number of papers on which developer is transferred, that is stored in the operation history storing section 48. Therefore, users (or maintenance persons) are not required to erase the operation history after the developer discharge is finished. Consequently, efficiency of the developer discharge is improved.

Particularly, in an image forming apparatus that performs operation such as correction of image formation conditions according to the operation history of developer, appropriate correction may not be carried out if the operation history is not erased after developer discharge is finished. However, by having the main control section 101 automatically erasing the operation history at the end of the developer discharge as described above, defects in correcting image formation conditions are prevented even when the operation history is not reset.

Embodiment of Program

Further, the members constituting the developer discharge control section 40 (main control section 101, potential difference control section 41, photoconductive drum drive control section 42, charging control section 43, development bias control section 44, development unit drive control section 45, intermediate transfer belt separation control section 47) are functional blocks that are realized by executing a program code. The program code is stored in a recording medium such as ROM or RAM and is read out and executed by operation means such as CPU. More specifically, the object of the present invention is achieved through the following procedure. A recording medium storing a computer-readable program code (execute form program, intermediate code program, source program) of a program (control program) that acts as software realizing the above functions is supplied to a system or a device, and a computer (or CPU) in the system or the device reads out the program code from the recording medium to execute the functions.

Meanwhile, the members may be realized as hardware that performs the same process as to those of the foregoing software. In this case, the object of the present invention is achieved by a set of hardware: the main control section 101, the potential difference control section 41, the photoconductive drum drive control section 42, the charging control section 43, the development bias control section 44, the development unit drive control section 45, and the intermediate transfer belt separation control section 47. Further, the members may be realized by a combination of hardware that performs a part of the process, and the operation means for executing a program code that controls the hardware and performs the rest of the process not performed by the hardware. Further, the foregoing hardware members may also be realized by a combination of hardware that performs a part of the process and the operation means for controlling the hardware and executing the program codes to perform the rest of the process not performed by the hardware.

The operation means may be realized by a single section or by a plurality of operation means. In the case of plural means, they are connected via a bus or various communication paths in the device, and cooperate to execute the program code.

Accordingly, the developer discharge control section 40 of the present invention may be disposed at an arbitrary position in the printing device. In the above embodiments, the developer discharge control section 40 is included in the image forming apparatus 100. However, for example, the developer discharge control section 40 may be included in a computer connected to the image forming apparatus 100. Further, the developer discharge control section 40 may be provided as an independent device. Moreover, the developer discharge control section 40 may be structured as an image processing apparatus in which a part of members are included in the printing device or in the computer, and the rest are provided as independent sections. In this case, the members are associated with each other as a system to realize the functions.

Further, a program code that can be directly executed by the operation means, or a program in a form of data that can create program codes by a process of, for example, decompressing (described below), is stored in a recording medium. Then, by distributing the recording medium, or by transmitting the program by communication means through a wired or wireless communication path, the program or data is executed by the operation means.

In the case of transmission through the communication path, various transmission media forming the communication path propagate each other signal strings indicating the program. Further, in transmitting the signal strings, the transmitter may modulate the carrier-wave according to the signal strings so that the signal strings are superposed on the carrier-wave. In this case, the receiver demodulates the carrier-wave so that the signal strings are recovered. Meanwhile, the transmitter may transmit the signal strings as packets which are made by splitting digital data constituting the signal string. In this case, the receiver concatenates packet groups that have been received so as to recover the signal strings. As further alternative, the transmitter may multiplex the plural signal strings by a method such as time division/frequency division/sign division. In this case, the receiver extracts each of the multiplexed signal strings so as to recover them individually. In all of the above cases, the same effects can be obtained as long as the program is transmittable through the communication path.

Here, it is preferable that the recording medium used for distributing the program be removable, but the recording medium after the program is distributed may be either removable or irremovable. Further, the recording medium above means any medium to store the program, and may be either rewritable (recordable) or non-rewritable, volatile or non-volatile. The storage mode and format are also not limited. Examples of the recording medium include: a tape such as a magnetic tape, a cassette tape or the like; and a disk such as (i) a magnetic disk (a floppy disk (registered trademark), a hard disk or the like), (ii) an optical disk such as a CD-ROM (MO), (iii) a mini disk (MD), (iv) a digital video disk (DVD) or the like. Further, the recording medium may be a card, such as an IC card or an optical card, or a semiconductor memory, such as a mask ROM, an EPROM, an EEPROM, or a flash ROM. Further, the recording medium may be a memory, for example a CPU, that is formed in the operation means.

The program codes may be to instruct the operation means to perform the whole process of the members. However, if there already exists a master program (for example, operating system or library) that is read out by a predetermined step to execute a part of or the whole functions of the foregoing members, the predetermined step for reading the master program may instead be instruction to execute the part of or the whole of the functions, which is given to the operation means using a code or a pointer.

Further, the program may be stored in the recording medium in various ways. For example, the program may have a format to be placed in a real memory, with which the operation means can read out and execute the program. Further, the program may be a format as installed in a local recording medium (for example, the format before the program is stored in a real memory, with which the operation means can access the program at any time. Moreover, the program may have a format before the program is installed in the local recording medium from a network or a portable recording medium.

Further, the program is not limited to object codes after being compiled. The program may be stored in the recording medium as a source code or an intermediate code that are generated through interpretation or compiling. In both cases, the same effects can be obtained regardless the format in the recording medium, as long as the intermediate code are convertible to an executable format by the operation means, by a process of or a combination of processes of: decompression of compressed information; restoration of encoded information; interpretation; compiling; linking; and storage to an actual memory.

As described above, in order to solve the above problem, an image forming apparatus of the present invention includes: development means for developing an electrostatic latent image formed on a photoconductor, using developer including toner and carrier; discharge means for discharging developer from the development means; charging control means for controlling a photoconductor potential that is a surface potential of a face of the photoconductor, which face is opposite to the development means; development bias control means for controlling a development bias potential that is a surface potential of a face of the development means, which face is opposite to the photoconductor; and main control means for controlling the charging control means and the development bias control means so that a potential difference between the photoconductor potential and the development bias potential in developer discharge from the development means is smaller than the potential difference in image forming.

In the above structure, during the developer discharge from the development means, the potential difference between the photoconductor potential and the development bias potential is smaller than that in the image forming. Therefore, even when the amount of developer in the development section decreases due to the developer discharge, increase of beads-carry-over onto the photoconductor from the development section can be prevented. Accordingly, damage to the photoconductor or image errors due to incomplete cleaning that are caused by beads-carry-over can be prevented.

Further an image forming apparatus of the present invention may further include timer means for measuring an elapsed time, which is counted since the developer discharge from the development means is started, characterized in that: the main control means controls the charging control means and the development bias control means to change the potential difference between the photoconductor potential and the development bias potential in such a way that, immediately after the developer discharge from the development means is started, the potential difference is equivalent to the potential difference in image forming, and when a predetermined time has passed since the developer discharge from the development means is started, the potential difference is smaller than the potential difference in image forming.

If the potential difference between the photoconductor potential and the development bias potential is set, immediately after the developer discharge is started, smaller than that in image forming, toner may be transported onto the photoconductor (so-called "fog" is generated). Therefore, it is preferable that the potential difference between the photoconductor potential and the development bias potential be set small after a certain time period that is long enough for the fog not to be generated has passed, rather than immediately after the developer discharge is started.

In the above structure, immediately after the developer discharge from the development means is started, the potential difference between the photoconductor potential and the development bias potential is set equivalent to that in image forming. On the other hand, when the predetermined time has passed since the developer discharge from the development means is started, the potential difference between the photoconductor potential and the development bias potential is set smaller than that in image forming. This prevents "fog" caused by toner adhesion onto the photoconductor.

Further, an image forming apparatus of the present invention may further include: discharge mode set means for accepting an instruction to select a developer discharge mode so as to execute the developer discharge from the development means; and timer means for measuring an elapsed time, which is counted since the instruction to select the developer discharge mode is accepted, characterized in that: the main control means controls the charging control means and the development bias control means to change the potential difference between the photoconductor potential and the development bias potential in such a way that, immediately after the instruction to select the developer discharge mode is accepted, the potential difference is equivalent to the potential difference in image forming, and when a predetermined time has passed since the instruction to select the developer discharge mode is accepted, the potential difference is smaller than the potential difference in image forming.

In the above structure, immediately after the instruction to select the developer discharge mode is accepted, the potential difference between the photoconductor potential and the development bias potential is equivalent to that in the image forming. In other words, immediately after the developer discharge from the development means is started, the potential difference between the photoconductor potential and the development bias potential is equivalent to that in the image forming. This prevents "fog" caused by toner adhesion onto the photoconductor.

Further, when the predetermined time period has passed since the instruction to select the developer discharge mode is accepted, the potential difference between the photoconductor potential and the development bias potential is set smaller than that in image forming. Therefore, even when the amount of developer in the development section decreases due to developer discharge, increase of beads-carry-over onto the photoconductor from the development section can be prevented. Accordingly, damage to the photoconductor or image errors due to incomplete cleaning that are caused by beads-carry-over can be prevented.

Further, an image forming apparatus of the present invention may further include: intermediate transfer means for transferring a developer image, which is developed on the photoconductor by the development means, to a recording sheet; separation means for separating the intermediate transfer means from the photoconductor; and separation control means for controlling operation of the separation means, characterized in that: the main control means controls the separation control means such that the separation means separates the intermediate transfer means from the photoconductor before the developer discharge from the development means is started or during the developer discharge.

In the above structure, before the developer discharge is started or during the developer discharge, the intermediate transfer means is separated from the photoconductor. This prevents damage that would be caused by beads-carry-over onto the photoconductor. Specifically, damage to the photoconductor and the intermediate transfer means that would be caused by carriers in contact with the intermediate transfer means can be prevented or reduced. Moreover, damage to the intermediate transfer means that would occur when a carrier transferred from the photoconductor to the intermediate transfer means is removed can be prevented or reduced.

Even if the potential difference between the photoconductor potential and the development bias potential during developer discharge is set smaller than that in image forming, it is not possible to completely get rid of the beads-carry-over. Therefore, the photoconductor and the intermediate transfer means are separated from each other before developer discharge is started or during developer discharge so that damage to the photoconductor and the intermediate transfer means can be prevented or reduced. In order to more effectively prevent the damage of intermediate transfer means due to developer discharge, it is preferable that the photoconductor and the intermediate transfer means be separated from each other before developer discharge is started.

Further, the development means may include: a developer tank for storing the developer; and developer transport means for drawing the developer so as to transport the developer from the developer tank to the face of the development means (opposite to the photoconductor), and the developer transport means draws the developer from a portion below its surface level at a time before the developer is discharged. In other words, the development means may adopt a drawing system. The height of the developer before the developer is discharged (surface level of the developer before the developer is discharged) indicates the surface level of the developer at a time when a sufficient amount of developer for smoothly developing the electrostatic latent image on the photoconductor is stored in the developer tank.

In the above structure, the developer transport means draws and transports developer from a portion below its surface level at a time before the developer is discharged. With this arrangement, the amount of developer to be shifted by the developer transport means (amount of developer to be transported) is less affected by a change in the amount of developer remained in the developer tank after developer discharge is executed. Therefore, congestion of magnetic chains on the developer transport means can be gradually changed from a crowded state to a sparse state, taking sufficient time from when the developer discharge is started. This shortens the period in which the congestion of the magnetic chains stays in the sparse state during developer discharge. Further, because the congestion of the magnetic chains changes gradually, it is easy to predict the change in the congestion of the magnetic chains. This allows the photoconductor potential and the development bias potential to be accurately controlled at an appropriate timing. Therefore, the beads-carry-over onto the photoconductor can be effectively prevented.

Further, an image forming apparatus of the present invention may further include: developer transport means for transporting the developer to the face of the development means (opposite to the photoconductor), the developer transport means being provided in the development means; photoconductor drive control means for controlling rotation of the photoconductor; and developer transport drive control means for controlling rotation of the developer transport means, characterized in that: the main control means controls the photoconductor drive control means and the developer transport drive control means to change a peripheral speed of the photoconductor during the developer discharge from the development means, in such a way that, the peripheral speed of the photoconductor is same as a peripheral speed of the developer transport means, and the peripheral speed of either or both of the photoconductor and the developer transport means is (are) slower than a peripheral speed(s) thereof in development of an electrostatic latent image formed on the photoconductor.

In the above structure, the rotation of the photoconductor and the developer transport means is controlled such that, during the developer discharge from the development means, the peripheral speed of the photoconductor is same as the peripheral speed of the developer transport means, and the peripheral speed of either or both of the photoconductor and the developer transport means is (are) slower than a peripheral speed(s) thereof in development of an electrostatic latent image formed on the photoconductor.

This reduces a frequency of contacts between the photoconductor and the magnetic chains of the developer on the developer transport means. Therefore, probability of occurrence of beads-carry-over is reduced, thereby effectively preventing the beads-carry-over.

In this case, it is preferable that the main control means control the photoconductor drive control means and the developer transport drive control means to change a peripheral speed of the photoconductor during the development discharge from the development means, in such a way that the peripheral speed of the photoconductor is same as the peripheral speed of the developer transport means, and the peripheral speed of the developer transport means is slower than the peripheral speed thereof in development of an electrostatic latent image formed on the photoconductor.

By lowering the rotation speed of the developer transport means, physical detachment of carriers can be reduced, thereby effectively preventing the beads-carry-over.

Further, an image forming apparatus of the present invention may further include timer means for measuring an elapsed, which is counted since the developer discharge from the development means is started, characterized in that: the main control means controls the photoconductor drive control means and the developer transport drive control means such that, when a predetermined time period n1 has passed since the developer discharge is started, the peripheral speed of the photoconductor is same as the peripheral speed of the developer transport means, and the peripheral speed of the developer transport means is slower than the peripheral speed thereof in development of an electrostatic latent image formed on the photoconductor; and main control means stops the rotation of the photoconductor when a predetermined time period n2 (n2>n1) has passed since the developer discharge is started.

In the above structure, carriers transported onto the photoconductor during the developer discharge are further transported to, for example, cleaning means provided for removing the carriers. This prevents damage, such as scratches, on the cleaning means or the photoconductor. Further, it is preferable that the third predetermined value be set at a density or a liquid surface level of the developer of when the magnetic chains are so reduced that the photoconductor would not be damaged by magnetic chains shifted to the opposite face of the development means to the photoconductor even when the magnetic chains are brought into contact only with a particular part of the photoconductor being stopped.

Further, an image forming apparatus of the present invention may further include detection means for detecting a density or a liquid surface level of the developer in the development means, characterized in that: the main control means controls the charging control means and the development bias control means to change the potential difference between the photoconductor potential and the development bias potential in such a way that, immediately after developer discharge from the development means is started, the potential difference is equivalent to the potential difference in image forming, and when the density or the liquid surface level of the developer that is detected by the detection means reaches a predetermined value after the developer discharge from the development means is started, the potential difference is smaller than the potential difference in image forming.

As described above, if the potential difference between the photoconductor potential and the development bias potential is set, immediately after the developer discharge is started, smaller than that in image forming, toner may be transported onto the photoconductor (so-called "fog" is generated). Therefore, it is preferable that the potential difference between the photoconductor potential and the development bias potential be set small after a sufficient time period that is long enough for the fog not to be generated, rather than immediately after the developer discharge is started.

In the above structure, the detection means detects the density or the liquid surface level of the developer, and the photoconductor potential and the development bias potential are controlled according to this detection result. This allows accurate detection in the change in congestion of the magnetic chains on a face of the development means that is opposite to the photoconductor according to the actual amount of residual developer in the development means, even when a liquidity of the developer is changed due to operation environment or deterioration in quality. Therefore, the potential difference between the photoconductor potential and the development bias potential can be accurately controlled according to the detection result by the detection means, thereby effectively preventing the beads-carry-over.

Further, in an image forming apparatus of the present invention, the main control means causes the charging control means and the development bias control means to stop controlling the photoconductor potential and the development bias potential when the main control means determines completion of the developer discharge from the developer means according to a detection result of the detection means.

In the above structure, completion of the developer discharge is detected by the detection means, and the control for photoconductor potential and the development bias potential is stopped according to the detection result. This allows the control to be stopped at an appropriate timing.

Further, an image forming apparatus of the present invention may further include: developer transport means for transporting the developer to the face of the development means (opposite to the photoconductor), the developer transport means being provided in the development means; photoconductor drive control means for controlling rotation of the photoconductor; and developer transport drive control means for controlling rotation of the developer transport means, characterized in that: when the density or the liquid surface level of the developer detected by the detection means reaches a second predetermined value after the developer discharge from the development means is started, the main control means causes the photoconductor drive control means and the transport drive control means to control rotation of the photoconductor and the developer transport means, in such a way that a peripheral speed of the photoconductor is same as a peripheral speed of the developer transport means, and the peripheral speed of either or both of the photoconductor and the developer transport means is (are) slower than a peripheral speed(s) thereof in development of an electrostatic latent image formed on the photoconductor; and when the density or the liquid surface level of the developer detected by the detection means reaches a third predetermined value, the main control means causes the photoconductor drive control means to stop rotation of the photoconductor.

In the above structure, carriers transported onto the photoconductor during the developer discharge are further transported to, for example, cleaning means provided for removing the carriers. This prevents damage, such as scratches, on the cleaning means or the photoconductor. Further, actuation of the photoconductor and the developer transport means is controlled according to the detection result by the detection means so that these means are driven under precise control according to the actual amount of residual developer in the development means. Further, it is preferable that the third predetermined value be set at a density or a liquid surface level of the developer of when the magnetic chains are so reduced that the photoconductor would not be damaged by magnetic chains shifted to the opposite face of the development means to the photoconductor even when the magnetic chains are brought into contact only with a particular part of the photoconductor being stopped.

Further, in an image forming apparatus of the present invention, the development means adopts an AC superposition development method in which an alternating current component is superposed on the development bias potential; and the main control means causes the development bias control means to remove the alternating current component from the development bias potential when the developer is discharged from the development means.

In the above structure, the electric field is reciprocated, during the developer discharge, by the alternating current component superposed on the development bias potential. This prevents increase of beads-carry-over onto the photoconductor. Therefore, even when the amount of developer in the development means decreases after the developer discharge is executed, the beads-carry-over onto the photoconductor would not increase.

Further, an image forming apparatus of the present invention may further include memory means for storing operation history after previous replacement of the developer in the development means, characterized in that: the memory means resets the operation history when developer discharge from the development means is finished.

In the above structure, the main control means resets the operation history stored in the memory means when developer discharge is finished. Therefore, users are not required to manually carry out resetting of the operation history after developer discharge is finished. Consequently, efficiency of developer discharge is improved.

Particularly, in an image forming apparatus that, for example, corrects image forming conditions based upon the operation history of the developer, if the operation history is not reset after developer discharge is finished, the image forming conditions may not be appropriately corrected. However, by thus presetting the main control means to reset the operation history when the developer discharge is finished, detects in correcting image formation conditions are prevented even when the operation history is not reset.

Further, in order to solve the above problems, a method of controlling operation of an image forming apparatus during developer discharge, which includes (i) development means for developing an electrostatic latent image formed on a photoconductor, using developer including toner and carrier; and (ii) discharge means for discharging developer in the development means, characterized in that, a potential difference between a photoconductor potential and a development bias potential in developer discharge from the development means is smaller than the potential difference in image forming, the photoconductor potential being a surface potential of a face of the photoconductor, which face is opposite to the development means, the development bias potential being a surface potential of a face of the development means, which face is opposite to the photoconductor.

In the above structure, during the developer discharge from the development means, the potential difference between the photoconductor potential and the development bias potential is set smaller than that in image forming. Therefore, even when an amount of developer in the development section decreases due to developer discharge, increase of beads-carry-over onto the photoconductor from the development section can be prevented. Accordingly, damage to the photoconductor or image errors due to incomplete cleaning that are caused by beads-carry-over can be prevented.

A program of the present invention causes a computer to execute a function of control means in one of the image forming apparatuses described above. The program is read by a computer so that functions of the control means (main control means, charging control means, development bias control means, photoconductor drive control means, transport drive control means, separation control means) of an image forming apparatus of the present invention can be executed by the computer.

Further, the program is stored in a computer-readable recording medium so that the program can easily be saved and distributed. Moreover, by reading the recording medium, a computer can execute a function of control means in an image forming apparatus of the present invention.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image forming apparatus, comprising:

development means for developing an electrostatic latent image formed on a photoconductor, using developer including toner and carrier, the development means including a developer tank for storing developer, developer conveying means for pumping the developer up from the developer tank and conveying the developer to a surface facing the photoconductor, and a developer discharge outlet provided on a bottom surface of the developer tank;

discharge means for discharging developer from the development means, the discharge means having opening and closing means for opening and closing the developer discharge outlet, the developer being discharged from the developer tank via the developer discharge outlet by closing the developer tank via the developer discharge outlet by closing the developer discharge outlet with use of the opening and closing means at a time of image forming so that the developer does not leak from the developer tank via the developer discharge outlet, and by opening the developer discharge outlet with operation of the opening and closing means at a time of developer discharge;

charging control means for controlling a photoconductor potential that is a surface potential of a face of the photoconductor, which face is opposite to the development means;

development bias control means for controlling a development bias potential that is a surface potential of a face of the development means, which face is opposite to the photoconductor; and main control means for controlling the charging control means and the development bias control means so that a potential difference between the photoconductor potential and the development bias potential during developer discharge from the development means and after a predetermined period of time has elapsed since the start of developer discharge is smaller than the potential difference in image forming.

2. An image forming apparatus as set forth in claim 1, further comprising: timer means for measuring an elapsed time, which is counted since the developer discharge from the development means is started, wherein:

the main control means controls the charging control means and the development bias control means to change the potential difference between the photoconductor potential and the development bias potential in such a way that, before a predetermined time determined from the timer means has passed since the developer discharge from the development means is started, the potential difference is equivalent to the potential difference in image forming, and when the predetermined time has passed since the developer discharge from the development means is started, the potential difference is smaller than the potential difference in image forming.

3. An image forming apparatus as set froth in claim 1, further comprising:

discharge mode set means for accepting an instruction to select a developer discharge mode so as to execute the developer discharge from the development means; and timer means for measuring an elapsed time, which is counted since the instruction to select the developer discharge mode is accepted, wherein:

the main control means controls the charging control means and the development bias control means to change the potential difference between the photoconductor potential and the development bias potential in such a way that, before a predetermined time determined from the timer means has passed since the instruction to select the developer discharge mode is accepted, the potential difference is equivalent to the potential difference in image forming, and when the predetermined time has passed since the instruction to select the developer discharge mode is accepted, the potential difference is smaller than the potential difference in image forming.

4. An image forming apparatus as set forth in claim 1, further comprising:

intermediate transfer means for transferring a developer image, which is developed on the photoconductor by the development means, to a recording sheet;

separation means for separating the intermediate transfer means from the photoconductor; and separation control means for controlling operation of the separation means, wherein:

the main control means controls the separation control means such that the separation means separates the intermediate transfer means from the photoconductor before the developer discharge from the development means is started or during the developer discharge.

5. An image forming apparatus as set forth in claim 1, wherein:

the development means comprises:

a developer tank for storing the developer; and developer transport means for drawing the developer so as to transport the developer from the developer tank to the face of the development means (opposite to the photoconductor), and the developer transport means draws the developer from a portion below its surface level at a time before the developer is discharged.

6. An image forming apparatus as set forth in claim 1, further comprising:

developer transport means for transporting the developer to the face of the development means (opposite to the photoconductor), the developer transport means being provided in the development means;

photoconductor drive control means for controlling rotation of the photoconductor; and developer transport drive control means for controlling rotation of the developer transport means, wherein:

the main control means controls the photoconductor drive control means and the developer transport drive control means to change a peripheral speed of the photoconductor during the developer discharge from the development means, in such a way that, the peripheral speed of the photoconductor is same as a peripheral speed of the developer transport means, and the peripheral speed of either or both of the photoconductor and the developer transport means is (are) slower than a peripheral speed(s) thereof in development of an electrostatic latent image formed on the photoconductor.

7. An image forming apparatus as set forth in claim 6, wherein:

the main control means controls the photoconductor drive control means and the developer transport drive control means to change a peripheral speed of the photoconductor during the development discharge from the development means, in such a way that, the peripheral speed of the photoconductor is same as the peripheral speed of the developer transport means, and the peripheral speed of the developer transport means is slower than the peripheral speed thereof in development of an electrostatic latent image formed on the photoconductor.

8. An image forming apparatus as set forth in claim 6, further comprising:

timer means for measuring an elapsed, which is counted since the developer discharge from the development means is started, wherein:

the main control means controls the photoconductor drive control means and the developer transport drive control means such that, when a predetermined time period n 1 has passed since the developer discharge is started, the peripheral speed of the photoconductor is same as the peripheral speed of the developer transport means, and the peripheral speed of the developer transport means is slower than the peripheral speed thereof in development of an electrostatic latent image formed on the photoconductor; and main control means stops the rotation of the photoconductor when a predetermined time period n2 (n2 >n1) has passed since the developer discharge is started.

9. An image forming apparatus as set forth in claim 1, further comprising:

detection means for detecting a density or a liquid surface level of the developer in the development means, wherein:

the main control means controls the charging control means and the development bias control means to change the potential difference between the photoconductor potential and the development bias potential in such a way that, before the density or the liquid surface level of the developer that is detected by the detection means reaches a predetermined value since developer discharge from the development means is started, the potential difference is equivalent to the potential difference in image forming, and when the density or the liquid surface level of the developer that is detected by the detection means reaches the predetermined value after the developer discharge from the development means is started, the potential difference is smaller than the potential difference in image forming.

10. An image forming apparatus as set forth in claim 9, wherein:

the main control means causes the charging control means and the development bias control means to stop controlling the photoconductor potential and the development bias potential when the main control means determines completion of the developer discharge from the developer means according to a detection result of the detection means.

11. An image forming apparatus as set forth in claim 9, further comprising:

developer transport means for transporting the developer to the face of the development means (opposite to the photoconductor), the developer transport means being provided in the development means;

photoconductor drive control means for controlling rotation of the photoconductor; and developer transport drive control means for controlling rotation of the developer transport means, wherein:

when the density or the liquid surface level of the developer detected by the detection means reaches a second predetermined value after the developer discharge from the development means is started, the main control means causes the photoconductor drive control means and the transport drive control means to control rotation of the photoconductor and the developer transport means, in such a way that a peripheral speed of the photoconductor is same as a peripheral speed of the developer transport means, and the peripheral speed of either or both of the photoconductor and the developer transport means is (are) slower than a peripheral speed(s) thereof in development of an electrostatic latent image formed on the photoconductor; and when the density or the liquid surface level of the developer detected by the detection means reaches a third predetermined value, the main control means causes the photoconductor drive control means to stop rotation of the photoconductor.

12. An image forming apparatus as set forth in claim 1, wherein:

the development means adopts an AC superposition development method in which an alternating current component is superposed on the development bias potential; and the main control means causes the development bias control means to remove the alternating current component from the development bias potential when the developer is discharged from the development means.

13. An image forming apparatus as set forth in claim 1, further comprising:

memory means for storing operation history after previous replacement of the developer in the development means, wherein:

the memory means resets the operation history when developer discharge from the development means is finished.

* * * * *